US005834171A

United States Patent [19]

Suzuki et al.

[11] Patent Number: 5,834,171

[45] Date of Patent: Nov. 10, 1998

[54] SOLID PROCESSING COMPOSITION FOR SILVER HALIDE PHOTOGRAPHIC LIGHT SENSITIVE MATERIAL

[75] Inventors: Tetsuya Suzuki; Akira Shimizu; Kenji Ishida; Hiroshi Yamashita, all of Hino, Japan

[73] Assignee: Konica Corporation, Tokyo, Japan

[21] Appl. No.: 782,045

[22] Filed: Jan. 10, 1997

[30] Foreign Application Priority Data

| | | | |
|---|---|---|---|
| Jan. 16, 1996 | [JP] | Japan | 8-004764 |
| Mar. 29, 1996 | [JP] | Japan | 8-076562 |
| May 23, 1996 | [JP] | Japan | 8-128557 |

[51] Int. Cl.[6] ..... G03C 5/305

[52] U.S. Cl. ..... 430/465; 430/480; 430/483; 430/490

[58] Field of Search ..... 430/465, 480, 430/483, 490

[56] References Cited

U.S. PATENT DOCUMENTS

| | | | |
|---|---|---|---|
| 2,688,548 | 9/1954 | Reynolds | 430/480 |
| 2,688,549 | 9/1954 | James et al. | 430/480 |
| 3,867,151 | 2/1975 | Katz | 430/465 |
| 4,238,345 | 12/1980 | Guilbert | 510/321 |
| 4,816,384 | 3/1989 | Fruge et al. | 430/465 |
| 5,272,045 | 12/1993 | Patel et al. | 430/465 |
| 5,362,610 | 11/1994 | Yoshimoto | 430/465 |
| 5,382,507 | 1/1995 | Shimizu et al. | 430/465 |
| 5,405,732 | 4/1995 | Shimizu et al. | 430/465 |
| 5,457,010 | 10/1995 | Satake et al. | 430/465 |
| 5,510,231 | 4/1996 | Komatsu et al. | 430/465 |
| 5,512,424 | 4/1996 | Yoshimoto | 430/465 |
| 5,587,276 | 12/1996 | Katoh | 430/440 |

FOREIGN PATENT DOCUMENTS 0 687 951 A1 12/1995 European Pat. Off. .

*Primary Examiner*—Hoa Van Le

*Attorney, Agent, or Firm*—Frishauf, Holtz, Goodman, Langer & Chick, P.C.

[57] ABSTRACT

A solid processing composition for developing a silver halide black-and-white photographic light sensitive material containing a compound represented by the following formula as a developing agent, in which a metabisulfite, or the metabisulfite and a sulfite is contained in an amount of 1 to 50% by weight of the composition, a molar ratio of the sulfite to the metabisulfite being not more than 0.85.

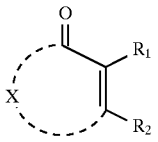

6 Claims, No Drawings

SOLID PROCESSING COMPOSITION FOR SILVER HALIDE PHOTOGRAPHIC LIGHT SENSITIVE MATERIAL

DETAILED EXPLANATION OF THE INVENTION

FIELD OF THE INVENTION

The present invention relates to a solid processing composition for use in a silver halide photographic light sensitive material (hereinafter, referred to as a photographic material) and a processing method by use thereof and, in particular, to a solid processing composition superior in storage stability and with markedly shortened dissolution time, and to a processing method by use thereof, improved in silver stain (silver sludge) and residual color due to sensitizing dye residue at the time when processed at low replenishing rate.

BACKGROUND OF THE INVENTION

Silver halide black and white photographic light sensitive materials for use in radiography, printing-plate making, microfilms and negative films have been processed with an alkaline developing solution containing hydroquinone as a developing agent and 3-pyrazolidone type or aminophenol type compound as an auxiliary developing agent. However, the hydroquinone has drawbacks with respect to safety in terms of biology and toxicology, and also such defects as heavy load in waste liquor treatments. As is well known, ethylene diols such as ascorbic acid have no problem in safety and act as a developing agent. However, compared to the hydroquinone developing solution, a developing solution containing ascorbic acid has problems such as the developing solution undergoing hydrolysis under high alkalinity to form an acid, thereby lowering the pH and losing chemical developing activity.

In general, a large amount of a sulfite, which is commonly known as an antioxidant (preservative) is dissolved in a developing solution. However, the sulfite causes silver halide to dissolve out in the developing solution, leading to occurrence of stains due to silver which has been reduced in the developing solution (silver sludge). Further, in response to the desire for reduction of waste processing liquor, lowering of replenishing rates of a processing solution has been attempted. However, this resulted in problems not only of an increase of silver staining but also residual dye defects on processed films. Accordingly, improvements thereof have been sought.

Conventionally, a processing composition is stored in plastic resin bottles in the form of a concentrated solution, and marketed and sold as a processing composition kit. The processing kit is diluted with water to prepare a working solution. However, since the processing kit is a concentrated solution, there are problems of safety. Further, it is quite heavy and needs more space for storage, resulting in increased transportation cost. In order to reduce these costs and promote safety, techniques for preparing the processing chemicals in the form of a tablet were considered. However, with regard to processing chemicals for the black-and-white photographic material, not only the problem described above but also problems of the tablet-forming technique, including storage stability, lubricity during tablet formation by compression-molding, stability of the tablet and solubility in preparing a solution, have not yet been resolved. With regard to the stability of the tablet, in particular, processing is generally conducted under alkaline environments, resulting in a tablet containing an alkali agent, which produces a tablet poor in stability and, therefore, a technique for improvement thereof is eagerly sought.

SUMMARY OF THE INVENTION

In response to the above-described problems, an objective of the present invention is to provide a solid processing composition superior in storage stability, lubricity during tablet formation by compression-molding, and stability of the tablet with markedly shortened dissolution time; and a processing method of the photographic material, showing reduced defects such as silver stain (which is also known as silver sludge) and reduced sensitizing dye residue.

The above objective can be accomplished by the following means.

1. A solid processing composition for developing a silver halide photographic light sensitive material containing a compound represented by the following formula (1) as a developing agent, in which a metabisulfite, or the metabisulfite and a sulfite is contained in an amount of 1 to 50% by weight of the composition, wherein a molar ratio of the sulfite to the metabisulfite and the sulfite is not more than 0.85.

Formula (1)

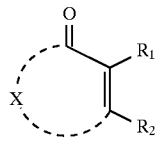

In the formula, $R_1$ and $R_2$ each represent a hydroxy group, amino group, acylamino group, alkylsulfonylamino group, arylsulfonylamino group, alkoxysulfonylamino group, mercapto group or alkylthio group; X represents a atomic group necessary for forming a 5- or 6-membered ring.

2. The solid processing composition for the photographic material described in 1, wherein said solid processing composition contains a saccharide and/or a compound represented by the following formula (2) in an amount of 0.5 to 30% of the total weight.

$$HO—(A_1—O)_{l_1}—(A_2—O)_{l_2}—(A_3—O)_{l_3}—H \quad \text{Formula (2)}$$

In the formula, $A_1$, $A_2$ and $A_3$ each represents a substituted or unsubstituted alkyl group, which may be straight-chained or branched; $l_1$, $l_2$ and $l_3$ each represent 0 or an integer of 1 to 500, provided that $l_1+l_2+l_3 \leqq 5$.

3. The solid processing composition for the photographic material described in above 1 and 2, wherein said solid processing composition contains an organic sulfur compound represented by the following formula (3) in amount of 0.01 to 3.0% of the total weight.

$$R—S_xO_yM \quad \text{Formula (3)}$$

In the formula, R represents an aliphatic group, aromatic group or heterocyclic group; x is 1 or 2; y is an integer of 2 to 8; and M represents a cation.

4. A solid processing composition for a silver halide photographic light sensitive material, said solid processing composition containing an alkali agent and a polysaccharide.

5. The solid processing composition for the photographic material described in above 4, wherein said solid processing composition contains the organic sulfur compound represented by formula (3) in an amount of 0.01 to 3.0% of the total weight.

6. The solid processing composition for the photographic material described in above 1 through 5, wherein said solid processing composition is in the form of a tablet prepared by compression-molding.

7. A solid processing composition for the photographic material in the form of a tablet which is prepared by compression-molding, wherein a solid processing composition containing an alkali agent is mixed with a polysaccharide and the mixture is subjected to compression-molding to form the tablet.

8 A method for processing a silver halide photographic light sensitive material comprising the processing steps of developing and fixing, wherein a processing solution prepared by dissolving any of the solid processing composition describing in 1 through 7 is used in the processing steps.

9 The method for processing a silver halide photographic material described in 8, wherein a developing solution as said processing solution contains a carbonate in an amount of not less than 0.3 mol/l and less than 0.8 mol/l and a sulfite in an amount of not less than 0.05 mol/l and less than 0.3 mol/l.

10 The method for processing a silver halide photographic material described in 8 or 9, wherein the photographic material is processed at a replenishing rate of 15 ml or less per sheet of 10×12 inch size.

DETAILED DESCRIPTION OF THE INVENTION

The compound represented by formula (1) will be more in detail. The compound represented by formula (1) is generally known as reductons.

In the formula, $R_1$ and $R_2$ each represent a hydroxy group; an amino group, which may be substituted by a substituent such as ethyl, n-butyl, hydroxyethyl or an alkyl group having 1 to 10 carbon atoms; an acylamino group such as acetylamino or benzoylamino; alkylsulfonylamino group such as methanesulfonylamino; an arylsulfonylamino group such as benzenesulfonylamino or p-toluenesulfonylamino; an alkoxysulfonylamino group such as methoxycarbonylamino; mercapto group or an alkylthio group such as methylthio or ethylthio. Of these, $R_1$ and $R_2$ each are preferably a hydroxy group, an amino group, alkylaminosulfonyl group or arylsulfonylamino group. X is an atomic group necessary for forming 5- or 6-membered ring. Preferably, the ring is comprised of a carbon atom, oxygen atom or nitrogen atom, and two vinyl carbon atoms which are substituted by $R_1$ and $R_2$ and a carbonyl carbon atom are combined with each other to form a 5- or 6-membered ring. As constituting examples of X, the ring is constituted by a combination of —O—, —$CR_3(R_4)$—, —$C(R_5)$=, —C(=O)—, —$N(R_6)$—, and —N=, in which $R_3$, $R_4$, $R_5$ and $R_6$ each represent a hydrogen atom, hydroxy group, carboxy group or an alkyl group having 1 to 10 carbon atoms which my be substituted by a substituent such as a hydroxy group, carboxy group or sulfoxy group. The 5- or 6-membered ring may be condensed to form saturated or unsaturated ring. Examples of the 5- or 6-membered ring includes a dihydroxyfuranone ring, dihydroxypyrrone ring, pyranone ring, cyclopentenone ring, pyrolinone ring, pyrazolinone ring, pyridone ring, azacyclohexenone ring and uracil. Of these, the dihydroxyfuranone ring, cyclopentenone ring, cyclohexenone ring, pyrazolinone ring, azacyclohexenone ring and uracil ring are preferred.

The compound represented by formula (1) form a lithium, sodium, potassium or ammonium salt.

Exemplary examples of the compound are shown as below, but the invention is by no means limited to these.

1-1

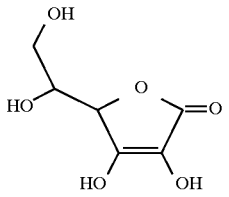

1-2

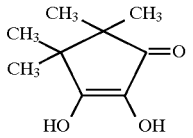

1-3

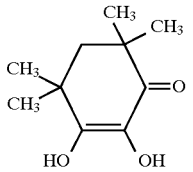

1-4

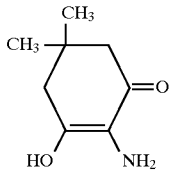

1-5

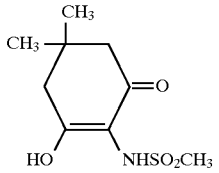

1-6

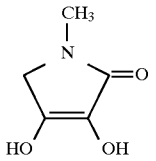

1-7

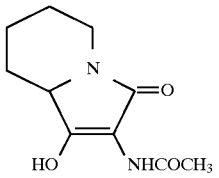

1-8

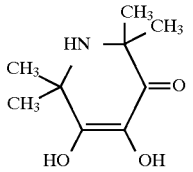

1-9

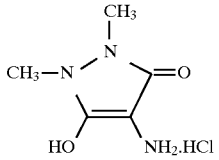

-continued 1-10

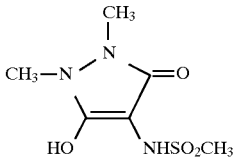

1-11

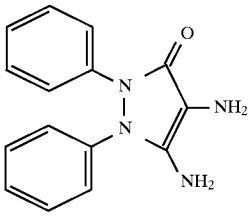

1-12

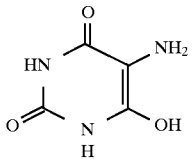

1-13

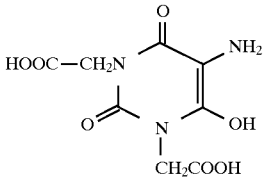

1-14

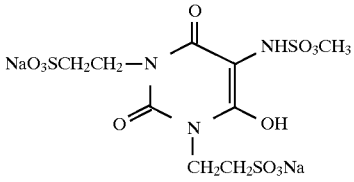

1-15

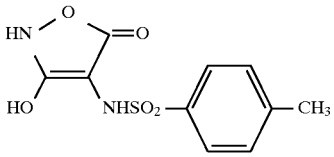

1-16

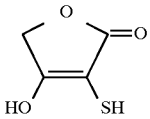

1-17

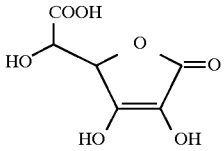

1-18

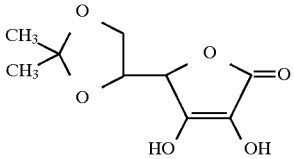

-continued 1-19

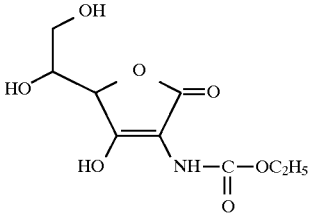

1-20

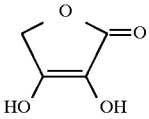

1-21

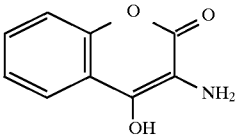

1-22

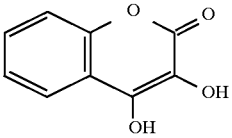

Of the above examples, ascorbic acid (1—1) or its stereoisomer, erythorbic acid is preferred. The compound represented by formula (1) is preferably contained in an amount of 30% by weight or more and more preferably, 50% by weight or more of the solid processing composition. The addition amount into a processing solution is not limitative but, in practice, a range of 0.1 to 100 g, and preferably, 0.5 to 60 g per liter of the processing solution is desired for preventing the formation of white precipitates. The processing solution used in the invention may contain the compound represented by formula (1) singly or in combination.

Next, the solid processing composition used in the invention and a developing solution obtained by dissolving the solid processing composition will be described. In addition to the above-described reducton, the developing solution may contain the following developing agents. Black-and-white developing agents include dihydroxybenzenes (e.g., hydroquinone, chlorohydroquinone, bromohydroquinone, dichlorohydroquinone, isopropylhydroquinone, methylhydoquinone, 2,3-dichlorohydoquinone, methoxyhydoquinone, 2,5-dimethylhydoquinone, potassium hydoquinone-monosulfonate, sodium hydoquinone-monosulfonate); 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4-hydroxymethyl-3-pyrazolidone, 1-phenyl-4,4-dihydroxymethyl-3-pyrazolidone, 1-p-tolyl-3-pyrazolidone, 1-phenyl-2-acetyl-4,4-dimethyl-3-pyrazolidone, 1-(2-benzothiazole)- 3-pyrazolidone, 3-acetoxy-1-phenyl-3-pyrazolidone); aminophenols (e.g., o-aminophenol, p-aminophenol, N-methyl-o-aminophenol, methyl-p-aminophenol, 2,4 diaminophenol); 1-aryl-3-aminopyrazolidones (e.g., 1-(p-hydroxyphenyl)-3-aminopyrazolidone, 1-(p-methylaminophenyl)-3-aminopyrazolidone); pyrazolones (e.g., 4-aminopyrazolone); and a mixture thereof. These developing agents may be incorporated into the solid processing composition or into a solution prepared by dissolving the solid processing composition.

The solid processing composition containing the compound represented by formula (1) contains a metabisulfite.

The metabisulfite is contained singly or in combination with a sulfite. The metabisulfite, or the metabisulfite and sulfite is contained in a total amount of 1 to 50%, and preferably, 3 to 30% of the total weight of the solid processing composition. A molar ratio of the sulfite to the metabisulfite and the sulfite is preferably not more than 0.85, more preferably not more than 0.60 and furthermore preferably not more than 0.35. In cases when the solid processing composition is dissolved in a processing solution, the content of the sulfite in the processing solution is not less than 0.05 mol/l and less than 0.3 mol/l, preferably, not less than 0.1 mol/l and less than 0.3 mol/l.

Further, a buffering agent (e.g., carbonates, boric acid, borates, alkanolamine, etc.), alkali agent, solubilizing aid (e.g., polyethylene glycols and esters thereof), pH adjusting agent (e.g., organic acid such as citric acid), sensitizer (e.g., quaternary ammonium salt), development-accelerating agent, hardening agent (e.g., dialdehydes such as glutar aldehyde), surfactant, azole type organic antifoggant (e.g., indazoles, imidazoles, benzimidazoles, tetrazoles, thiadiazoles), and sequestering agent for sequestering calcium ions contained in tap water used for a processing solution (e.g., sodium hexametaphosphate, calcium hexametaphosphate, polyphosphates) are usable. These may be contained in the solid processing composition or added to the processing solution in which the solid processing composition is dissolved. Furthermore, an anti-silver staining agent may be usable, as described in JP-A 56-24347 (herein, the expression, "JP-A" means unexamined and published Japanese Patent Application).

A developing solution usable in the invention has a pH of 10.5 or less, preferably, 9.0 to 10.2. The developing solution may contain an amino-compound such as alkanolamines described in JP-A 56-106244. The developing solution may further contain compounds described in F. A. Mason, "Photographic Processing Chemistry", Focal press (1966), pages 22–229; U.S. Pat. Nos. 2,193,015 and 2,592,364; and JP-A 48-64933. These compounds may be contained in the solid processing composition or added to the processing solution in which the solid processing composition is dissolved.

The alkali agent refers to a compound including a hydroxide or carbonate of alkaline metals and alkaline earth metals and a compound which exhibit alkalinity when dissolved in an aqueous ammonia or amine solution. Of these, in the invention, a carbonate is preferred, which has also buffering action. Examples thereof includes potassium carbonate, sodium carbonate and lithium carbonate. The carbonate is contained in the developing solution, in an amount of not less than 0.3 mol/l and less than 0.8 mol/l.

The solid processing composition containing the compound reprersented by formula (1) may contain a saccharide and/or a compound represented by formula (2). The content thereof is preferably not less than 0.5% and less than 30%, more preferably, not less than 3% and less than 20%, based on the weight of the solid processing composition.

The saccharides in the invention refer to monosaccharides or polysaccharides in which monosaccharides are combined with each other through a glycoside bond including a derivative thereof or a decomposition product thereof.

Monosaccharides refer to as a polyhydroxy aldehyde, polyhydroxy ketone and their derivatives such as reduction derivatives, oxidation derivatives, deoxy-derivatives, amino-derivatives or thio-derivatives. Most of them are represented by the general formula $C_{n'}(H_2O)m'$. The monosaccharide in the invention includes a compound derived from saccharide skeleton represented by the above formula. The preferable is a sugar alcohol having a primary or secondary alcohol group to which an aldehyde or ketone group is reduced.

Polysaccharides include celluloses, starches or glycogens. The celluloses include derivatives such as cellulose ethers in which all or a part of hydroxy group are etherified, and starches include maltose or dextrins that starches are hydrolyzed to various decomposition compounds. Celluloses may be in an alkali salt form in view of solubility. Among polysaccharides, celluloses or dextrins are preferably used, and dextrins are more preferably used.

Examples of monosaccharides including a derivative thereof in the invention will be shown below.

(Exemplified compounds)

B-(1) Glycelaldehyde
B-(2) Gihydroxyacetone (including a dimer)
B-(3) D-erythlose
B-(4) L-erythlose
B-(5) D-threose
B-(6) L-threose
B-(7) D-ribose
B-(8) L-ribose
B-(9) D-arabinose
B-(10) L-arabinose
B-(11) D-xylose
B-(12) L-xylose
B-(13) D-lyxose
B-(14) L-lyxose
B-(15) D-xylulose
B-(16) L-xylulose
B-(17) D-ribulose
B-(18) L-ribulose
B-(19) 2-Deoxy-D-ribose
B-(20) D-allose
B-(21) L-allose
B-(22) D-altrose
B-(23) L-altrose
B-(24) D-glucose
B-(25) L-glucose
B-(26) D-mannose
B-(27) L-mannose
B-(28) D-gulose
B-(29) L-gulose
B-(30) D-idose
B-(31) L-idose
B-(32) D-galactose
B-(33) L-galactose
B-(34) D-talose
B-(35) L-talose
B-(36) D-quinovose
B-(37) Digitalose
B-(38) Digitoxose
B-(39) Cymarose
B-(40) D-sorbose
B-(41) L-sorbose
B-(42) D-tagatose
B-(43) D-fucose
B-(44) L-fucose
B-(45) 2-Deoxy-D-glucose
B-(46) D-psicose
B-(47) D-fructose
B-(48) L-fructose
B-(49) D-rhamnose
B-(50) D-glucosamine
B-(51) L-glucosamine
B-(52) D-mannosamine
B-(53) D-glycero-D-galactoheptose B-(54) D-glycero-D-mannoheptose
B-(55) D-glycero-L-mannoheptose
B-(56) D-glycero-D-guloheptose
B-(57) D-glycero-D-idoheptose
B-(58) D-glycero-L-glucoheptose
B-(59) D-glycero-L-taloheptose
B-(60) D-altroheptulose
B-(61) D-mannoheptulose
B-(62) D-altro-3-heptulose
B-(63) D-glucuronic acid
B-(64) L-glucuronic acid
B-(65) N-acetyl-D-glucosaiaine
B-(66) Glycerin
B-(67) D-threitol
B-(68) L-threitol
B-(69) Meso-erithorit (produced by Mitsubishi Kasel Shokuhin Co. Ltd., Erythritol)
B-(70) D-arabitol
B-(71) L-arabitol
B-(72) adonitol
B-(73) xylitol
B-(74) D-sorbitol
B-(75) L-sorbitol
B-(76) D-mannitol
B-(77) L-mannitol
B-(78) D-iditol
B-(79) L-iditol
B-(80) D-talitol
B-(81) L-talitol
B-(82) Dulcitol
B-(83) Allodulcitol Of these compounds, B-(66) through (83) are preferably used, and B-(69) and B-(74) through (83) are more preferably used.

Examples of polysaccharides and their decomposition products in the invention will be shown below.

C-(1) Maltose
C-(2) Cellobiose
C-(3) Trehalose
C-(4) Gentiobiose
C-(5) Isomaltose
C-(6) Lactose
C-(7) Raffinose
C-(8) Gentianose
C-(9) Stachyose
C-(10) Xylan
C-(11) Araban
C-(12) Glycogen
C-(13) Dextran
C-(14) Inulin
C-(15) Levan
C-(16) Galactan
C-(17) Agalose
C-(18) Amylose
C-(19) Sucrose
C-(20) agarobiose
C-(21) Methylcellulose
C-(22) Dimethylcellulose
C-(23) Trimethylcellulose
C-(24) Ethylcellulose
C-(25) Diethylcellulose
C-(26) Triethylcellulose
C-(27) Carboxymethylcellulose
C-(28) Carboxyethylcellulose
C-(29) Aminoethylcellulose
C-(30) Hydroxymethylcellulose
C-(31) Hydroxyethylcellulose
C-(32) Hydroxypropylcellulose
C-(33) Hydroxypropylmethylcellulose
C-(34) Hydroxypropylmethylcelluloseacetatesuccinate
C-(35) Carboxymethylhydroxyethylcellulose
C-(36) α-Dextrin
C-(37) β-Dextrin
C-(38) γ-Dextrin
C-(39) δ-Dextrin
C-(40) ϵ-Dextrin
C-(41) α-Limit-dextrin
C-(42) β-Limit-dextrin
C-(43) Phospherylase limit dextrin
C-(44) Soluble starch
C-(45) Thin-boling starch
C-(46) White dextrin
C-(47) Yellow dextrin
C-(48) British gum
C-(49) α-Cyclodextrin
C-(50) β-Cyclodextrin
C-(51) γ-Cyclodextrin
C-(52) Methyl-α-Cyclodextrin
C-(53) Methyl-β-Cyclodextrin
C-(54) Methyl-γ-Cyclodextrin
C-(55) Hydroxypropyl-α-cyclodextrin
C-(56) Hydroxypropyl-β-cyclodextrin
C-(57) Hydroxypropyl-γ-cyclodextrin
C-(58) Maltodextrin Saccharides exist widely in the nature, and are also commercially available. The derivatives can be readily prepared by reduction, oxidation or dehydration reactions.

As commercially available cyclodetrins are cited α-100 H, β-100, γ-100, K-100, Isoelite P, Isoelite PH, Methy-β-CD, Hydroxypropyl-β-CD (each, product by Ensuiko Seitoh Corp.); and starch compounds available on the market include Pineflow, Pine-dex series, Max 100, Glistar P, TK-16, MPD, H-PDX and Stuco-dex produced by Matsutani Kagaku Co., Ltd. or Oil Q series produced by Nihon Yushi Co., Ltd.

Next, compounds represented by Formula (2) in the invention will be explained concretely as follows.

$$HO—(A_1—O)_{l1}—(A_2—O)_{l2}—(A_3—O)_{l3}—H$$

In the formula, $A_1$, $A_2$ and $A_3$ each represent a straight chained or branched alkylene group, which may be substituted and these may be either the same or different.

As a substituent, there may be given a hydroxy group, a carboxy group, a sulfonyl group, an alkoxy group, a carbamoyl group and a sulfamoyl group. Preferably, $A_1$, $A_2$ and $A_3$ are each an unsubstituted alkylene group. More preferably $A_1$, $A_2$ and $A_3$ each are $—CH_2CH_2—$ or $—CH(CH_3)—CH_2—$. $l_1$, $l_2$ and $l_3$ each represent 0 or integers of 1–500, provided that the total number thereof is equal to or larger than 5 ($l_1+l_2+l_3 \leqq 5$). Among the foregoing, preferably, at least one of $l_1$, $l_2$ and $l_3$ is 15 or more and more preferably, at least one of $l_1$, $l_2$ and $l_3$ is 20 or more.

When a compound represented by Formula (2) in the invention is a copolymer wherein two kinds of monomers A and B are copolymerized, those having configurations shown below are also included.

—A—B—A—B—A—B—A—B—A—B—
—A—A—B—A—B—B—A—A—A—B—A—A—B—B—A—
—A—A—A—A—A—A—B—B—B—B—B—B—A—A—A—A—A—

Among those copolymers is preferable a block polymer (nonionic polymer of a Pluronic type) of ethylene glycol and propylene glycol represented by the following Formula (2-1).

$$HO—(CH_2CH_2—O)_{l4}—[CH(CH_3)CH_2—O]_{l5}—(CH_2CH_2—O)_{l6}—H \quad \text{Formula (2-1)}$$

In the formula, $l_4$, $l_5$ and $l_6$ are the same as those defined in $l_1$, $l_2$ and $l_3$ in the afore-mentioned Formula (2).

In a compound represented by Formula (2-1) in the invention, it is preferable that the content (wt %) of ethyleneoxide in the total molecular weight is 70 wt % or more, and it is especially preferable that the content is 80 wt % or more.

Exemplary compounds represented by Formula (2) and Formula (2-1) are further shown below. Compound, HO—($CH_2$—$CH_2$—O)n"—H:

| | Average molecular weight |
|---|---|
| 2-1 | 300 |
| 2-2 | 600 |
| 2-3 | 1000 |
| 2-4 | 1500 |
| 2P-5 | 2000 |
| 2-6 | 3000 |
| 2-7 | 4000 |
| 2-8 | 6000 |
| 2-9 | 10000 |
| 2-10 | 15000 |
| 2-11 | 20000 |
| 2-12 | 30000 |

Compound, HO—($CH_2CH_2$—O)a'—[CH($CH_3$)—$CH_2$—O]b'—($CH_2CH_2$—O)c'—H:

| | Content (wt %) of ethyleneoxide in the total molecular weight | Average molecular weight |
|---|---|---|
| 2-1-1 | 80 | 8350 |
| 2-1-2 | 80 | 10800 |
| 2-1-3 | 50 | 4600 |
| 2-1-4 | 70 | 6500 |
| 2-1-5 | 80 | 5000 |
| 2-1-6 | 50 | 3500 |
| 2-1-7 | 70 | 7850 |
| 2-1-8 | 50 | 4150 |

In the above formulas, n' is an integer of 5 or more; and a', b' and c' have the same definition as $l_1$, $l_2$ and $l_3$, as afore-described.

Among compounds represented by Formula (2) and Formula (2-1) in the invention, the most preferable is polyethylene glycol (hereinafter referred to sometimes as PEG).

In the case of polyethylene glycol, those having an average molecular weight ranging from 2000 to 20000 are preferable, and especially preferable includes those having an average molecular weight ranging from 3000 to 15000.

The average molecular weight in the invention is a molecular weight determined based on a hydroxyl value. The compound represented by formula (2) may be used singly or in combination.

The solid processing composition relating to the invention contains an organic oxide compound represented by formula (3) in an amount of 0.01 to 3.0%, preferably, 0.1 to 2.5% and more preferably, 0.5 to 2.0% by weight of the solid processing composition.

In formula (3), the aliphatic group represented by R includes an alkyl group, an alkenyl group and an alkynyl group. Examples of the alkyl group includes methyl ethyl, i-propyl, butyl, t-butyl, pentyl, cyclopentyl, hexyl, cyclohexyl, octyl and decyl. The alkyl group may be substituted by a substituent, including a halogen atom (e.g., chlorine, bromine, fluorine), alkoxy group (e.g., methoxy, ethoxy, 1,1-dimethylethoxy, hexyloxy, dodecyloxy), aryloxy (e.g., pheoxy, naphthoxy), aryl group (phenyl naphthyl), alkoxycarbonyl group (e.g., methoxycarbonyl, ethoxycarbonyl, butoxycarbonyl, 2-ethylhexylcarbonyl), aryloxycarbonyl group (e.g., pheoxycarbonyl, naphthyloxycarbonyl), alkenyl group (e.g., vinyl, allyl, heterocyclic group (e.g., 2-piperidyl, 3-pyridyl, 4-pyridyl, morpholyl, piperazyl, pyrimidyl, pyrazolyl, furyl), alkynyl group (e.g., propargyl), amino group (e.g., amino, N,N-dimethylamino, anilino), cyano group, sulfonamido group (e.g., methysulfonylamino, ethylsulfonylamino, octylsulfonylamino, phenylsulfonylamino). The alkenyl group includes vinyl and allyl. The alkynyl group includes propargyl group.

The aromatic group represented by R includes, for example, a phenyl group or naphthyl group The heterocyclic group represented by R includes, for example, a pyridyl group (e.g., 2-pyridyl, 3-pyridyl, 4-pyridyl), thiazolyl group, oxazolyl group, imidazolyl group, furyl group, thienyl group, pyrrolyl group, pyradynyl, pyrimidinyl, pyridazinyl, selenazolyl, sulforanyl, piperidinyl, pyrazolyl tetrazolyl).

The above-described alkenyl group, alkynyl group, aromatic group and heterocyclic group represented by R may be substituted. Substituents are the same as those in the case of the alkyl group.

M is preferably a metal ion or an organic cation. Examples of the metal ion include lithium ion, sodium ion, potassium ion. The organic cation includes an ammonium ion (e.g., ammonium, tetramethylammonium, tetrabutylammonium, phosphonium ion (e.g., tetraphenylphosphonium) and guanidyl.

It was proved that, in the formation tablet by compression-molding of the inventive solid processing composition containing the compound of formula (1), incorporation of the compound represented by formula (3) led to improvements in lubricity, hardness of the tablet and abrasiveness. On the other hand, It was proved that, in the formation tablet by compression-molding of the inventive solid processing composition not containing the compound of formula (1), the incorporation of the compound of formula (3) led to not only the same effects but also improvements in storage stability of a solution prepared by dissolving the solid processing composition.

The following examples are illustrative of the compound represented by formula (3), but are not to be construed as limiting the same.

$C_2H_5SO_3Na$ 3-1

$CH_3(CH_2)_6SO_3Na$ 3-2

$CH_3(CH_2)_7SO_3Na$ 3-3

$CH_3(CH_2)_5OSO_3Na$ 3-4

$CH_3(CH_2)_6OSO_3Na$ 3-5

$CH_3(CH_2)_7OSO_3Na$ 3-6

$CH_3O(CH_2)_2SO_3Na$ 3-7

3-8

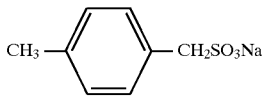

-continued

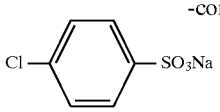

3-9

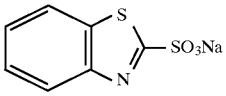

3-10

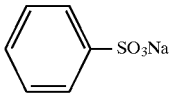

3-11

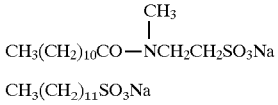

3-12

$CH_3(CH_2)_{11}SO_3Na$ 3-13

In cases where the solid processing composition contains an alkali agent, at least one polysaccharide is preferably contained. The alkali agent is preferably used in the form of granules or powder and the solid processing composition containing the alkali agent is preferably tableted by compression-molding thereof. In the compression-molding process, at least one polysaccharide is preferably incorporated.

As preferred polysaccharides are cited exemplified compounds C-(1) through C-(58). Of these compounds, cyclodextrins are particularly preferred. The cyclodextrins are exemplified compounds C-(49) through C-(58). The cyclodextrin can be formed by acting, on starch, amylase of a cyclodextrin forming enzyme, Bacillus macerans (cyclodextrin-glucanotransferase).

The cyclodextrin is a cyclic oligosaccharide comprised of at least six α-1,4-bonding glucoses, including α-cyclodextrin with a hexaglucose-ring (cyclohexaamylose), β-cyclodextrin with heptaglucose-ring (cycloheptaamylose), and γ- cyclodextrin with octaglucose-ring (cyclooctaamylose). Further, there are also known δ-cyclodextrin and ε-cyclodextrin with higher degree of polymerization, and branched cyclodextrins in which a monosaccharide such as glucose, maltose, celobiose, lactose or galactose, or a disaccharide is added or linked to the cyclodextrin.

The cyclodextrin used in the invention is preferably an alkyl cyclodextrin and particularly, methyl-β-cyclodextrin is preferred. The alkylcyclodextrin usable in the invention refers to a chemically modified cyclodextrin in which an alkyl group is bonded to the cyclodextrin. Examples of the alkyl group include methyl, ethyl, propyl, butyl and hydroxypropyl.

The cyclodextrin used in the invention is preferably in the form of powder. In the invention, the word, "powder" refers to coagulant of fine particles and granules are made up through granulation of the powder.

A fixing solution used in the invention is preferably prepared through preparation of a solid fixing composition and its dissolution in water. Thiosulfates are preferably used as a fixing agent. Examples of the thiosulfates include a lithium, potassium, sodium or ammonium thiosulfate. Of these are preferred ammonium thiosulfate and sodium thiosulfate to obtain a fixing solution with a high fixing speed.

Iodides or thiocyanates are also usable as the fixing agent. The fixing solution contains a sulfite. The sulfites include a lithium, potassium, sodium or ammonium sulfite.

The fixing solution may contain a water soluble chromium salt or aluminum salt. Examples of the water soluble chromium salt or aluminum salt include chromium alum, aluminum sulfate, potassium aluminum chloride, aluminum chloride.

The fixing solution may contain an acetate ion. The acetate ion is optionally usable and acetic acid and a lithium, potassium, sodium or ammonium acetate are preferably used. Of these, sodium or ammonium acetate is particularly preferred.

Furthermore, citric acid, tartaric acid, malic acid, succinic acid, phenylacetic acid or an optical isomer thereof may be contained. There is also usable a lithium, potassium, sodium or ammonium salt, such as potassium citrate, lithium citrate, sodium citrate, ammonium citrate, lithium tartarate, potassium tartarate, sodium hydrogentartarate, sodium tartarate, ammonium tartarate, ammonium hydrogentartarate, ammonium potassium tartarate, sodium potassium tartarate, sodium malate, ammonium malate, sodium succinate and ammonium succinate. Of these compounds are preferred citric acid, isocitric acid, malic acid, phenylacetic acid and salts thereof. As other acids, inorganic acids such as sulfuric acid, hydrochloric acid, nitric acid and boric acid and organic acids such as formic acid, propionic acid, oxalic acid and malic acid are each usable. Boric acid and aminopolycarboxylic acids are preferably used.

Aminopolycarboxylic acid such as nitrilotriacetic acid and ethylenediaminetetraacetic acid and salt thereof are used as a chelating agent. An anionic surfactant such as sulfuric esters and sulfonates, polyethylene glycol-type or ester-type nonionic surfactant, and amphoteric surfactant are used as a surfactant. As a lubricant is cited an alkanolamine or an alkylene glycol. As a fixing accelerator are cited thiourea derivatives, an alcohol having a triple bond and thioethers. The pH of the fixing solution is 3.8 or more and preferably 4.2 to 5.5.

The replenishing rate of the developing solution or the fixing solution is preferably not more than 15 ml per sheet of 10×12 inch, from the point of reduction of effluent. Within this range of the replenishing rate, effects of the present invention are enhanced.

In the invention, the solid processing composition is preferably in the form of granules or a tablet, and more preferably in the form of a tablet.

Next, solidification of the processing composition will be described. The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341.

A preferred tablet-making process is to form a tablet by compression-molding after granulating powdery processing composition. As compared to a solid composition prepared simply by mixing the processing composition to form a table, there is an advantage that improvements in solubility and storage stability were achieved and resultingly, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 μm and preferably 200 to 750 μm. In particular, 60% or more of the granules is with a deviation of ±100 to 150 μm. When the grain size smaller, it tends to cause localization of mixing elements and therefore, is undesirable. As hydraulic press machine, any conventional compression molding machine, such as a single-engined compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The processing composition in the form of a tablet can be prepared according to methods, as described in JP-A 51-61837, 54-155038, 52-88025, and British Patent 1,213,808. The granular processing composition can also be prepared according to methods. as described in JP-A 2-109042, 2-109043, 3-39735 and 3-39739. The powdery processing composition can be prepared according to methods, as described in JP-A 54-133332, British Patent 725,892 and 729,862 and German Patent 3,733,861.

In cases where the solid processing composition of the invention, its bulk density is preferably 1.0 to 2.5 g/cm$^3$ from the viewpoint of solubility and the point of effects of the invention. When being not less than 1.0 g/cm$^3$, it is advantageous for strength of the solid composition; and when being not more than 2.5 g/cm$^3$, it is advantageous for solubility. In cases where the composition in the form of granules or powder, the bulk density is preferably 0.40 to 0.95 g/cm$^3$.

A processing chemical having at least a part solidified and a solid processing chemical each applicable to the invention are included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

It is preferable that all the processing chemicals are solidified and are then replenished to the corresponding processing tanks so as to meet the information on a processing amount. When an amount of replenishing water is required, it is replenished in accordance with an information on a processing amount or another information on the replenishing water control. In this case, the liquids to be replenished to a processing tank can only be replenishing water. In other words, when a plurality of processing tanks are required to be replenished, the tanks for reserving some replenishing liquids can be saved to be only a single tank by making use of replenishing water in common, so that an automatic processor can be made compact in size. In particular for making the automatic processor compact in size, it is preferable to put a water replenishing tank to the outside of the automatic processor.

A preferable embodiment of a solid processing chemical applicable to the invention is that all of an alkali agent, a developing agent and a reducer are solidified when solidifying a color developer, and that, when a color developer is tableted, the numbers of the tablets may be not more than 4 tablets and, preferably, a single tablet. When the solid processing chemicals are solidified separately into not less than 2 tablets, it is preferable to pack these plural tablets or granules in the same package.

A moisture-proofed package for tablets or pills may be embodied of such a raw material as given below.

As for a synthetic resin material, any one of the following materials may be used; namely, polyethylene (including any one prepared in either a high-pressure method or a low-pressure method), polypropylene (either non-stretched or stretched), polyvinyl chloride, polyvinyl acetate, Nylon (either stretched or non-stretched), polyvinylidene chloride, polystyrene, polycarbonate, Vinylon, Evarl, polyethylene terephthalate (PET), other polyesters, rubber hydrochloride, an acrylonitrile-butadiene copolymer and an epoxy-phosphoric acid type resin (a polymer described in JP OPI Publication Nos. 63-63037/1988 and 57-32952/1982), or pulp.

The films of the above-given materials are usually made adhered to each other so as to be laminated. However, these materials may also be formed into a coated layer.

It is further preferable to provide a gas-barrier layer thereto. For example, an aluminium foil or an aluminium vacuum-evaporated synthetic resin is sandwiched between the above-mentioned synthetic resin films.

A total oxygen permeability of the above-mentioned laminated layers is, preferably, not higher than 50 ml/m$^2$ 24 hr/atm (at 20° C. and 65% RH) and, more preferably, not higher than 30 ml/m$^2$ 24 hr/atm.

A total thickness of the above-mentioned laminated layers is within the range of, preferably 1 to 2000 $\mu$m, more preferably 10 to 1000 $\mu$m and, further preferably 50 to 1000 $\mu$m.

The above-mentioned synthetic resin films may be comprised of a single (macromolecular) resin layer or not less than 2 laminated (macromolecular) resin layers.

As for a single macromolecular resin layer capable of satisfying the requirements of the invention, for example, the following materials may be used thereto.

(1) polyethylene terephthalate (PET) having a thickness of not thinner than 0.1 mm, (2) an acrylonitrile-butadiene copolymer having a thickness of not thinner than 0.3 mm, and (3) rubber hydrochloride having a thickness of not thinner than 0.1 mm.

Among them, polyethylene terephthalate can suitably be used in the invention, because it is also excellent in resistance to alkalinity and acidity.

Next, for a laminated macromolecular resin layer capable of satisfying the requirements of the invention, for example, the following materials may be used thereto.

(4) PET/a polyvinyl alcohol.ethylene copolymer (Evarl) /polyethylene (PE), (5) stretched polypropylene (OPP)/Eval/PE, (6) unstretched polypropylene (CPP)/Eval/PE, (7) Nylon (N)/aluminium foil (Al)/PE, (8) PET/Al/PE, (9) cellophane/PE/Al/PE,

(10) Al/paper/PE,

(11) PET/PE/Al/PE,

(12) N/PE/Al/PE,

(13) paper/PE/Al/PE,

(14) PET/Al/PET/polypropylene (PP),

(15) PET/Al/PET/high-density polyethylene (HDPE),

(16) PET/Al/PE/low-density polyethylene (LDPE),

(17) Evarl/PP,

(18) PET/Al/PP,

(19) paper/Al/PE,

(20) PE/PVDC coated Nylon/PE/Ethyl vinyl acetate.polyethylene condensate (EVA),

(21) PE/PVDC-coated N/PE,

(22) EVA/PE/Al-vacuum-evaporated Nylon/PE/EVA,

(23) Al-vacuum-evaporated Nylon/N/PE/EVA,

(24) OPP/PVDC-coated N/PE,

(25) PE/PVDC-coated N/PE,

(26) OPP/Eval/LDPE,

(27) OPP/Eval/CPP,

(28) PET/Eval/LDPE,

(29) ON (stretched Nylon)/Eval/LDPE, and

(30) CN (unstretched Nylon)/Eval/LDPE.

Among them, the above-given (20) through (30) can preferably be used.

As for the concrete constituents of the packaging materials, the following examples of the constituents may be given in the order from the inside of a package, provided that the packing material side coming into contact with a processing chemical is regarded as the inside;

PE/cardboard as a principal constituent/PE/Al/an epoxy-phosphoric acid type resin layer/a polyester type resin layer/PE, PE/K-Nylon/PE or an adhesive/Al/PE/cardboard/PE, PE/Vinylon/PE or an adhesive/Al/PE/cardboard/PE, PE/vinylidene chloride/PE or an adhesive/Al/PE/cardboard/PE, PE/polyester/PE or an adhesive/Al/PE/cardboard/PE, and Polypropylene/K-Nylon/polypropylene/Al/polypropylene/cardboard/polypropylene.

The methods of moisture-proof-packaging tablets or pills include, for example, the following methods, namely, Four-side sealing, Three-side sealing, Stick-like sealing (including a pillow-like or cassette-like sealing), PTP sealing, and Cartridge sealing.

The four-side sealing, 3-side sealing and stick-like sealing are classified by the shapes and these sealing methods can be applied to the above-given materials; provided when these sealing methods are utilized to a peal-open system, the sealing material is laminated with a sealant so that a peal-opening aptitude can be provided thereto.

The above-mentioned peal-open system generally includes a cohesive failure system, an interface pealing system and an interlayer pealing system.

The cohesive failure system is a system in which an adhesive called a hot-melt and a heat-seal lacquer are used as a sealer and a seal is peal-opened by cohesive failure in the inside of a sealant layer when the seal is to be opened.

The interface pealing system is a system in which a pealing is made on the interface between two layers of film, and a sealing film (so-called a sealant) and a matter subject to adhesion are not completely fused together, so that the peal-opening can be made by applying an appropriate force. The sealants include a film prepared by mixing a viscous resin therein. The materials of such a film may be selected from polyethylene or the copolymers thereof and polyesters so as to meet the materials of the matter subject to the adhesion.

The interface pealing system is a system in which a sealant is pealed apart between the layers of laminated films by making use of such a multilayer co-extruding film such as a laminated film.

In a peal-open system applied with a film of the invention, an interlayer pealing system or a interface pealing system is preferably used.

Such a sealant as mentioned above is relatively thin. Therefore, it is commonly used by laminating it on other film including, for example, those made of polyethylene, polypropylene, polystyrene, polycarbonate, a polyester (such as polyethylene terephthalate), polyvinyl chloride, Nylon, Evarl, and aluminium. From the viewpoints of moisture resistance, environmental protection and matching for a content of a package, polyethylene, polypropylene, polyester and Evarl may preferably be used. Taking a printability into consideration, it is preferable to use non-stretched polypropylene, polyester, paper sheet or the like as the outermost surface of a package.

The above-mentioned sealants include, for example, CMPS film manufactured by Tocello Co., Diclan PP-100 and PS-300 each manufactured by Dai-Nippon Ink Mfg., Co., LTD film manufactured by Toppan Printing Co., and San-Seal FR and MS each manufactured by San-Ei Chemical Co., and so forth. The polyester-laminated types thereof include, for example, Diclan C-1600 and C-1602T and so forth.

The above-mentioned PTP is a blister packaging form in which a solid processing chemical is put on a molded sheet made of PVC, CPP or the like and it is then heat-sealed with an aluminium material.

From the viewpoint of environmental protection, there is a tendency to avoid PVC from being used as a molding material. Recently, A-PET and a highly moisture-resistive PP (such as TAS-1130, TAS-2230 and TAS-3230 each manufactured by Taisei Chemical Industrial Co., Ltd.) have preferably been used.

When packing, binding or covering a processing chemical by making use of a water-soluble film or a binder, the water-soluble film or a binder each preferably applicable thereto include, for example, those comprising a basic material of a polyvinyl alcohol type, methyl cellulose type, polyethylene oxide type, starch type, polyvinyl pyrrolidone type, hydroxypropyl cellulose type, pullulan type, dextran type, gum arabic type, polyvinyl acetate type, hydroxyethyl cellulose type, carboxyethyl cellulose type, sodium carboxymethyl hydroxyethyl cellulose type, poly(alkyl) oxazoline type and polyethylene glycol type. Among them, those of a polyvinyl alcohol type and a pullulan type can more preferably be used from the viewpoint of the covering or binding effect.

The preferable polyvinyl alcohol is a very effective material for forming a film, because it has an excellent strength and flexibility under almost any conditions. Polyvinyl alcohol compositions available on the market, which are molded into a film, have various degrees of molecular weight and hydrolyses. However, the polyvinyl alcohol compositions are preferable to have a molecular weight within the range of 10000 to 100000, approximately. The term, "a degree of hydrolysis", herein means a ratio of the acetic acid group of polyvinyl alcohol is substituted by a hydroxyl group. When polyvinyl alcohol is applied to a film, the range of the hydrolysis is ordinarily within the range of 70% to 100% approximately. As mentioned above, the scope of the polyvinyl alcohol ordinarily include a polyvinyl acetate compound.

The above-mentioned water-soluble films can be prepared in such an ordinary process as described in JP-A 2-124945, 61-97348, 60-158245, 2-86638, 57-117867, 2-75650, 59-226018, 63-218741/1988 and 54-13565.

As for the water-soluble films, those available on the market under the brand names such as Solvlon (manufactured by Ai-Cello Chemical Co.), Hi-Cellon (manufactured by Nichigo Film Co.) or Pullulan (manufactured by Hayashibara Co.) may be used. Besides the above, a 7-000 series of polyvinyl alcohol films available from the MONO-SOL Division of Chris Craft Industries, Inc. can particularly preferable to be used, because these films can be dissolved in water at a temperature of 34° F. to 200° F. approximately and they can show a high chemical resistance without any harmfulness.

From the viewpoints of the preservability of a solid processing chemical, the dissolving time of a water-soluble film and the crystal deposition in an automatic processor, the layer thickness of the water-soluble film is to be within the range of, preferably 10 to 120$\mu$, particularly 15 to 80$\mu$ and, inter alia 20 to 60$\mu$.

The water-soluble films are preferable to be thermoplastic, because a heat-sealing or supersonic fusing treatment can readily be performed and a covering effect can more excellently be displayed.

The tensile strength of a water-soluble film is to be within the range of, preferably $0.5\times10^6$ to $50\times10^6$ kg/m$^2$, more preferably $1\times10^6$ to $25\times10^6$ kg/m$^2$ and, particularly $1.5\times10^6$ to $10\times10^6$ kg/m$^2$. The tensile strength is measured in the method specified in JIS Z-1521.

A photographic processing chemical packed, bound or covered by a water-soluble film or a binder is preferable to be packed in a moisture-resistive packaging material so as to be protected from a high moisture, a moisture in the air such as rain and mist, and an accidental damage produced by bringing the package into contacting with water by scattering water or by wet hand in the course of storing, transporting or handling the package. The moisture-resistive packaging materials include preferably a film having a thickness within the range of 10 to 150$\mu$. The material thereof is preferably at least a material selected from the group consisting of a polyolefin film such as those of polyethylene terephthalate, polyethylene and polypropylene, a sheet of craft paper capable of having a moisture-resistive effect displayable with polyethylene, waxed sheet of paper, moisture-resistive cellophane, glassine, polyester, polystyrene, polyvinyl chloride, polyvinylidene chloride, polyamide, polycarbonate, acrylonitrile and a metal foil such as those of aluminium, and a metallo-polymer. They may also be a compounded material of the above-given material.

In an embodiment of the invention, it is also preferable that a moisture-resistive material is made of a decomposable plastic including particularly a biodegradable or photolyzable plastic.

The biodegradable plastics include, for example, (1) those comprising a natural macromolecule, (2) a microbial growing polymer, (3) a synthetic polymer having a good biodegradation property, and (4) a compound of a biodegradable natural macromolecule to a plastic. The photolyzable plastics include, for example, (5) those having a group made present in the principal chain so as to be excited by UV rays and then coupled to a scission. Besides the above-given macromolecules, those having the two functions of a photolyzing and biodegrading properties at the same time may also effectively be used.

The typical and concrete examples thereof may be given as follows.

The examples of the biodegradable plastics may be given as follows;

(1) natural macromolecules, namely,
  A polysaccharide, cellulose, polylactic acid, chitin, chitosan, polyamino acid, and the modified thereof;

(2) microbial growing polymers, namely,
  "Biopol" comprising PHB-PHV (that is a copolymer of 3-hydroxybutylate and 3-hydroxybarrelate), and microbial growing cellulose;

(3) a synthetic polymer having a good biodegradation property, namely,
  polyvinyl alcohol, polycaprolactone and the copolymer or mixture thereof;

(4) a compound of a biodegradable natural macromolecule to a plastic, namely,
  a natural macromolecule having a good biodegradation property such as starch and cellulose, which is added to a plastic so that a configuration decaying property can be provided to the plastic.

(5) photolyzable plastics, namely,
  those introduced thereinto with a carbonyl group for providing a photodecaying property, and those added thereto with a UV absorbent for accelerating a decaying property.

As for such a decomposable plastics as mentioned above, those publicly described in, for example, "Chemistry and Industry", Vol. 64, No. 10, pp. 478–484, (1990); "The Kino Zairyo", July, 1990 Issue, pp. 23–34; may be used. Besides the above, it is also allowed to use the decomposable plastics available on the market, such as Biopol (manufactured by I.C.I.), Eco (manufactured by Union Carbide Corp.), Ecolite (manufactured by Eco Plastics, Inc.), Ecostar (manufactured by St.Lawrence Starch Co.) and Nackle P (manufactured by Japan-Unicar, Inc.).

The above-mentioned moisture-proofed packaging materials are to have a moisture permeability coefficient of not higher than 10 g·mm/m$^2$·24 hr and, preferably not higher than 5 g·mm/m$^2$·24 hr.

As for the means for supplying a solid processing chemical to a processing tank in the invention, and in the case where the solid processing chemical is of the tablet type, for example, there are such a well-known means as described in Japanese Utility Model OPI Publication Nos. 63-137783/1988, 63-97522/1988 and 1-85732/1989, wherein, in short, any means may be used, provided that at least a function for supplying a tableted chemical to a processing tank can be performed. And, in the case where the solid processing chemical is of the granulated or powdered type, there are such a well-known means such as the gravity dropping systems described in JP OPI Publication Nos. 62-81964/1987, 63-84151/1988 and 1-292375/1989, and the screw system described in JP OPI Publication Nos. 63-105159/1987 and 63-84151/1988. However, the invention shall not be limited to the above-given well-known means.

Among them, however, a preferable means for supplying a solid processing chemical to a processing tank is such a means, for example, that a prescribed amount of a solid processing chemical is weighed out in advance and is then separately packed and the package thereof is opened and the chemical is then taken out of the package so as to meet the quantity of light-sensitive materials to be processed. To be more concrete, every prescribed amount of a solid processing chemical and, preferably, every amount for a single replenishment is sandwiched between at least two packing materials constituting a package. When separating the package into two directions or opening a part of the package, the solid processing chemical can be ready to take out thereof. The solid processing chemical ready to be taken out thereof is readily be supplied to a processing tank having a filtration means by naturally dropping the chemical. The prescribed amounts of the solid processing chemicals are each separately packed respectively in a tightly sealed package so as to shut off the open air and the air permeability to any adjacent solid processing chemicals. Therefore, the moisture resistance can be secured unless the packages are opened.

In an embodiment of the invention, it may be to have a constitution in which a package comprising at least two packing materials sandwiching a solid processing chemical therebetween is brought into close contact with or made adhered to the peripheries of the solid processing chemical on each of the contacting surfaces of the two packing materials so as to be separable from each other, if required. When each of the packing materials sandwiching the solid processing chemical therebetween is pulled each to the different directions, the close contacted or adhered surfaces are separated from each other, so that the solid processing chemical can be ready to take it out.

In another embodiment of the invention, it may be to have the following constitution. In a package comprising at least two packing materials sandwiching a solid processing material therebetween, at least one of the packing materials thereof can be ready to open the seal by applying an external force. The expression, "to open a seal", stated herein means that a packing material is notched or broken off as a part of the packing material remains unnotched or unbroken off. It may be considered to open a seal in such a manner that a solid processing chemical is forcibly extruded by applying a compression force from the side of a packing material subject to be unopened through a solid processing chemical to the direction of a packing material made ready to be opened, or that a solid processing chemical can be ready to take out by notching a packing material subject to be opened by making use of a sharp-edged member.

A supply-starting signal can be obtained by detecting an information on a processing amount. Based on the obtained supply-starting signal, a driving means for separation or opening a seal is operated. A supply-stopping signal can be obtained by detecting an information on the completion of a specific amount of supply. Based on the obtained supply-stopping signal, a driving means for separation or opening a seal is so controlled as to be stopped in operation.

The above-mentioned solid processing chemical supplying means has a means for controlling the addition of a specific amount of the solid processing chemical, that is an essential requirement for the invention. To be more concrete, in an automatic processor of the invention, these means are required to keep every component concentration constant in each processing tank and to stabilize every photographic characteristic. The term, "an information of the processing amount of silver halide photographic light-sensitive materials", means an information on a value obtained in proportion to an amount of silver halide photographic light-sensitive materials to be processed with a processing solution, to an amount of silver halide photographic light-sensitive materials already processed or to an amount of silver halide photographic light-sensitive materials being processed, and the values indicate indirectly or directly an amount of a processing chemical reduced in a processing solution. The values may be detected at any point of time before and after a light-sensitive material is introduced into a processing solution or during the light-sensitive material is dipped in the processing solution. An amount of a light-sensitive material printed by a printer may also be detected for this purpose. A concentration or concentration variation of a processing solution reserved in a processing tank may further be detected. An amount discharged to the outside after a processing solution is dried up may also be detected.

A solid processing composition of the invention may be added to any position inside a processing tank and, preferably, to a position communicated with a section for processing a light-sensitive material and circulating a processing solution between the processing tank and the processing section. It is also preferable to have such a structure that a certain amount of processing solution can be circulated therebetween so that a dissolved component can be moved to the processing section. It is further preferable that a solid processing chemical is added to a thermostatically controlled processing solution.

Generally in an automatic processor, the temperature of a processing solution loaded therein is controlled by an electric heater. As for a general method thereof, a heat exchanger section is provided to an auxiliary tank connected to a processing tank and a heater is also provided thereto, and a pump is further arranged so as to circulate a given amount of the solution from the processing tank to the auxiliary tank and keep the temperature constant.

For the purpose of removing a crystallized foreign substance contained in a processing solution or produced in a crystallization, a filter is usually arranged.

It is allowed to connect a replenishing tank to a section connected to a processing section, such as the above-mentioned auxiliary tank.

All materials of the filters, filtration devices and so forth applicable to any ordinary automatic processors can also be used in the invention, and a specific structures and materials shall not affect the effects of the invention.

In the invention, the circulation frequency of a processing solution circulated by a circulation means is to be within the range of, 0.5 to 2.0 times/minute, preferably 0.8 to 2.0 times/minute and more preferably 1.0 to 2.0 times/minute. The expression, "a circulation frequency", herein is related to a flow rate of a liquid to be circulated, and one circulation herein means when a liquid amount corresponding to the total liquid amount reserved in a processing tank is flowed out. The solid processing composition is added to the processing tank, separately from the replenishing water. The replenishing water is supplied from the water storage tank.

Now, an antimolding means of a water replenishing tank of an automatic processor relating to the invention will be detailed. When a liquid exchange rate of a water replenishing tank is lowered so that a water retention time is prolonged, there raises such a problem that a fur is produced and a bad smell is also produced after 2 to 3 weeks, because water contained in the tank is spoilt. If a fur produced is replenished as it is, there raises such a serious problem that the fur adheres to a photographic material so that a development unevenness is produced when the fur adheres to a developing tank, and a fixing failure is produced so that the commercial value is seriously spoilt when the fur adheres to a fixing tank. Therefore, every tank is to be cleaned up periodically for removing a fur, so that it takes much time and requires much labor. Therefore, a water supplying tank of the invention has and antimolding means. The antimolding means can be achieved by at least one means selected from the group consisting of the following means.

1) A chelating agent adding means,
2) An antimold adding means,
3) A deionizing means,
4) A UV-ray irradiating means,
5) A magnetic treating means,
6) A supersonic treating means,
7) An electrolytic pasteurizing means,
8) A silver-ion releasing means,
9) An air bubbling means,
10) An active oxygen releasing means,
11) A means for coming into contact with a porous material,
12) A means for adding other harmless fungus to prevent any multiplication of harmful fungi.

Now, the above-mentioned means will concretely be detailed. As for the chelating agents and pasteurizers applicable to serve as an antimolding means in the invention, the following compounds can be used for example.

The chelating agents preferably applicable to the invention include, for example, ethylenediamine tetraacetic acid, diethylenetriamine pentaacetic acid, 1-hydroxyethylidene-1, 1-diphosphonic acid, ethylenediamine tetra(methylene phosphonic acid), 2-hydroxy-4-sulfophenol and 2-hydroxy-3,5-disulfophenol. The pasteurizers include, for example, a phenol type compound, a thiazole type compound and a benztriazole type compound. To be more concrete, the preferable compounds thereof include, for example, 1,2-benzisothiazoline-3-one, 2-methyl-4-isothiazoline-3-one, 2-octyl-4-isothiazoline-3-one, 5-chloro-2-methyl-isothiazoline-3-one, Sodium O-phenylphenol and benztriazole. When these compounds are collectively packed in one lot, they are preferable to be in the tablet form. When they have been dividedly weight in advance, they are preferable to be packed individually in an amount for a single usage.

As for the means for adding the chelating agent and pasteurizer, it is allowed that a chemical preparator may add them by hand. It is however preferable that a solid processing composition supply device is provided and they may be added thereby, and it is more preferable that a detector is provided to a water replenishing tank and they are automatically added when water is replenished up to a certain level of the tank, from the viewpoint of maintenance-free.

A means of the invention for modifying water with an ion-exchange resin can be embodied according to the means described in, for example, JP-A. 61-131632(1986).

The above-mentioned ion-exchange resins include, for example, various kinds of well-known cation-exchange resins (such as a strong acid type cation-exchange resin and a weak acid type cation-exchange resin) and various kinds of anion-exchange resins (such as a strong base type anion-exchange resin), of which are described in Technical Reports Laid Open to Public Inspection No. 90-473 and so forth. They may be used singly or in combination. It is ordinarily preferable to use a strong acid type H cation-exchange resin and a weak base type OH anion-exchange resin. It is also allowed either that they may be provided to a water replenishing tank, or that water may be modified at a separate place.

The preferable strong acid type ion-exchange resins include, for example, DIAION SK1B SK102, SK104, SK106, SK110, SK112 and SK116 (each manufactured by Mitsubishi Chemical Industries Co.), and the preferable Strong Base type OH Anion-exchange resins include, for example, DIAION PA406, PA408, PA412, PA416 and PA418 (each manufactured by Mitsubishi Chemical Industries Co.).

The means for irradiating UV rays can be embodied by, for example, the means described in JP OPI Publication No. 60-263939(1985). As for the UV-ray irradiation device, that manufactured by Kindai-Bio Laboratories, Inc. may preferably be used, because it is small in size. The means for generating a magnetic field may be embodied by such a means as described in JP OPI Publication No. 60-263939 (1985). The means for applying supersonic waves may be embodied by such a means as described in JP OPI Publication No. 60-262940(1985). The means for applying an electrolysis may be embodied by such a means as described in JP OPI Publication No. 3-22468(1991). The means for releasing Ag ion include, for example, such a means that a silver foil or silver plate is put in a water replenishing tank, that the inner wall of the tank is coated with silver, or that a silver-ion dischargeable compound is put in a water-replenishing tank.

The air bubbling means may be a very simple means in which air bubbles are blown into a water replenishing tank. The means may suitably be selected so as to match with the size of a water replenishing tank. As for the means for preventing water fur and microbe production, those of Nos. 1, 2, 3, 7 and 8 may preferably be used from the viewpoints of the compact size and economical efficiency. It is more preferable to select No. 1, 3 or 8.

The silver ion releasing compounds for Means No. 8) include, for example, silver chloride, silver bromide, silver iodide, silver oxide, silver sulfate and silver nitrate, and such an organic acid silver as silver acetate, silver oxalate, silver behenate and silver maleate.

In the invention, it is preferable to use the above-mentioned silver compound contained in either an $SiO_2$-$Na_2O$ type glassy substance having a network structure as the chemical structure thereof, or a zeolite having a tree-dimensional skeleton structure in which each of a methane type structured $SiO_4$ tetrahedron and an $AlO_4$ tetrahedron holds one oxygen atom in common.

The above-mentioned silver compounds, and a zeolite and a glassy substance each containing a silver compound may be commercially available. For example, they include Bio-Sure SG manufactured by Kinki Pipe Engineering Laboratories, Inc., Opargent Tablet manufactured by Opopharma AG (in Switzerland) and Zeomic manufactured by Cinnanen Zeomic Co.

Further, a silver compound and a zeolite or glassy substance containing a silver compound each relating to the invention may be used in any forms. For example, they may be powder-form, globular-shaped, pellet-shaped, fibriformed or filter-shaped. Or, they may also be used upon kneading them in such a fiber as cotton, wool and polyester fiber. As a example thereof is cited SANITER 30 manufactured by Kuraray Co.

Among them, the filter-shaped and globular-shaped ones are included in the preferable embodiments in the invention.

Further, one of the preferable embodiments of the invention also include such an embodiment that the silver compound, or zeolite or glassy substance containing the silver compound, is used upon putting it in a plastic case or a water-permeable container such as a tea-bag. Besides the above, Clinka 205 manufactured by Nippan Laboratories, Inc and Ruckin manufactured by Pacific Chemical Co. may also preferably be used.

Silver halide photographic light sensitive materials used in the invention are not limitative. Preferred examples of elements constituting the photographic material will be described as below.

A silver halide emulsion used in the photographic materials relating to the present invention can be prepared by a known method. A silver halide emulsion preferably applicable includes, for example, internally high iodide-containing, monodispersed grain emulsion, as disclised in JP-A 2-85846. The crystal habit may be cube, tetradecahedron, octahedron or a mixture of (111) and (100) faces.

A silver halide grain emulsion may have crystal structure having different halide composition between the inside and the outside of the grain.

Another silver halide emulsion also preferably applicable to the invention is a tabular-shaped grain having an average aspect ratio higher than 1. These tabular-shaped grains are disclosed in, for example, British patent No. 2,112,157, U.S. Pat. Nos. 4,439,520, 4,433,048, 4,414,310 and 4,434,226, JP-A 58-113927, 58-127921, 63-138342, 63-284272 and 63-305343, and so forth. Each of the disclosures expressly states that the advantages of these tabular-shaped grains are that the spectral sensitization efficiency, image graininess and image sharpness can be improved. These emulsions may be prepared in the processes described in the above-given disclosures. Particularly, the preparation processes preferably applicable include those described in, for example, Japanese Patent Application No. 4-289002(1992) (See pp.1–3), JP-A 59-177535 (See pp.2–5), Japanese Patent Application No. 4-277369(1992) (See pp.5–6), and JP-A 62-42146 (See pp.14–15).

The silver halide emulsion used in the invention is preferably comprised of silver iodobromide or silver iodochlorobromide, each of which contains 3 mol % or less iodide, silver bromide, silver chlorobromide, or silver chloride.

The above-mentioned emulsion may be any one of the surface latent image type for forming a latent image on the surface thereof, an internal latent image type for forming a latent image in the inside thereof and the type for forming latent images each on the surface and inside thereof. In the course of physically ripening or preparing the grains of these emulsions, they may be applied with cadmium salt, lead salt, zinc salt, thallium salt, iridium salt or the complex salts thereof, rhodium salt or the complex salts thereof, iron salt or the complex salts thereof, or the like. These emulsions may be subject to a washing treatment such as a noodle washing or flocculation-precipitation treatment so that a soluble salt may be removed. The preferable washing treatments, that is, the preferable desalting treatments include, for example, a treatment cited in JP Examined Publication No. 35-16086(1960) in which aromatic hydrocarbon type aldehyde resin containing a sulfo group is used, or a treatment cited in JP OPI Publication No. 63-158644 (1988) in which the flocculation high polymers exemplified therein as G3 and G8 and so forth are used. The processes for chemically ripening an emulsion preferably applicable to a light-sensitive material of the invention include, for example, a gold sensitization, a sulfur sensitization, a reduction sensitization, a sensitization to be made with a chalcogen compound, and the combination thereof.

The silver halide emulsion can be spectrally sensitized. Usable spectral-sensitizing dyes include cyanines, merocyanines, complex cyanines, complex merocyanines, holopolar cyanines, hemicyanines styryl dyes and hemioxonol dyes. As examples thereof are cited oxacarbocyanines, benzoimidazolocarbocyanines, and benzoimidazolooxacarbocyanines, as described in JP-A 5-113619. Dyes having sensitizing effects in a blue region described in JP-A 6-332102. The sensitizing dye may be used singly or in combination.

The sensitizing dye is preferably incorporated in a photographic component layer through solution in an organic solvent such as methanol. The sensitizing dye is incorporated in an amount of 10 to 900 mg and more preferably, 60 to 400 mg per mol of silver halide. The sensitizing dye is preferably added prior to completion of chemical ripening, in which the dye may be added separately in few times. The sensitizing dye is more preferably added after completion of grain growth and before completion of chemical ripening. Further preferably, the dye is added before start of chemical ripening.

Taking into account stability of the emulsion, it is preferred to use a chemical-ripening stopper for stopping chemical ripening. Examples of the chemical-ripening stopper include halides (e.g., potassium bromide, sodium chloride), antifoggants and stabilizer (e.g., 4-hydroxy-6-methyl-1,3,3a,7-tetrazaindene). These compounds may be used singly or in combination.

To the emulsions of a light-sensitive material applicable to the invention, a variety of photographic additives may be applied before or after carrying out a physical or chemical ripening step. A hydrazine or tetrazolium compound may also be added thereto.

A support applicable to a light-sensitive material relating to the invention include, for example, those given in the foregoing RD-17643, p.28 and RD-308119, p.1009.

The suitable supports include, for example, a plastic film. The surface of the support may be provided with a subbed layer and/or treated with a corona-discharge, UV irradiation or the like, so that the adhesion property of the resulting coated layer can be improved. Further, a crossover-cut layer and/or an antistatic layer may also be provided thereto.

An emulsion layer may be made present on both sides or one side only of a support. When the layers are on the both sides, the both sides may have the same or different characteristics.

The silver halide photographic light sensitive material relating to the invention preferably have a silver coverage (coating weight of silver) of not more than 5.0, more preferably, 2.0 to 3.5 g/m$^2$ and the content of the binder is preferably not more than 7.0, more preferably, 4.0 to 6.0 g/m$^2$.

EXAMPLES

Example 1

Solid developing composition relating to the present invention were prepared as follows.

Preparation of solid developing composition containing the compound of formula (1)

Preparation of granules (A):

1-Phenyl-3-pyrazolidone of 570 g, N-actyl-D,L-penicillamine of 10 g and sodium glutaraldehyde bissulfite of 1000 g each were pulverized up in a commercially available mill so as to have an average particle size of 10 $\mu$m. To the resulting fine particles, was added sodium sulfite and/or sodium bisulfite (as shown in Table 1) and 4000 g of sodium erythorbate, as a compound of formula (1), and further thereto, D-sorbit, D-mannit and polyethylene glycol (PEG) as a compound of formula (2) or poly(vinyl pyrrolidone) as a comparative compound were added, as shown in Table 1 and the mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. Further, the granules were subjected to dressing with a dressing machine provided with 1.0 mm mesh to obtain 24 kinds of granules (A), as shown in Table 1.

Preparation of solid developing composition in the form of tablet:

Each of the thus prepared 24 kinds of granules (A) was mixed for 10 min. by making use of a mixer in a room controlled at 25° C. and 40% or less RH. The mixture was subjected to compression-molding to form a tablet having a filling amount of 10 g per tablet, by making use of a tableting machine that was modified model of Tough Press Collect 1527HU manufactured by Kikusui Mfg. Works, Inc. Thereby, 24 kinds of developing composition in the form of a tablet having a diameter of 30 mm were prepared.

Evaluation of solubility:

Six tablets of each tablet sample were dissolved in 1 liter of tap water kept at 30° C. using a magnetic stirrer and the time until all tablets are completely dissolved was measured, based on visual observation.

Evaluation of storage stability:

Each tablet sample was packaged in aluminum packaging material at 23° C. and 40% RH. The package was allowed to stand for 2 weeks under the condition at 60° C. and 50% RH and thereafter, the package was opened and visually evaluated with respect to color-change of the tablet, as compared to tablets which were allowed to stand for 2 weeks at 23° C. and 40% RH, based on the following criteria.

A: Almost no change in color and white (no problem)

B: Slightly yellowish-changed (no problem in practice)

C: Yellowish-changed (problematic in practice)

D: Brownish-changed (problematic in practice)

Results thereof are shown in Table 1.

to the manner described below to obtain a developing composition in the form of a tablet.

Evaluation of lubricity:

Using a commercially available hydraulic press machine and die with a diameter of 30 mm, the granular mixture was subjected to compression-molding at a compression pressure of 7000 kg/cm$^2$ so as to have a filling amount of 10 g per tablet. In this case, pressure necessary for taking out a tablet from the die was measured by a load cell. Repeating this procedure five time, the average value of the pressure, which was referred to as releasing pressure, was compared as a measure of lubricity of the tablet.

Evaluation of hardness:

Five tablets of each tablet sample obtained by the above procedure were measured with respect to hardness, using a hardness tester (TS-50N, produced by Okada Seiko Co.) and the average value thereof was evaluated as a hardness (or strength) of the tablet.

Evaluation of abrasiveness:

Tablet samples were allowed to stand for 1 week under the condition at 25° C. and 40% RH. Thereafter, five tablets of each sample were put in a tablet abrasion tester (product by Kayagaki Rika Kogyo Co.); after rotating for 5 min., the surface of the tablet was brushed off and the tablets were evaluated with respect to degree of abrasion, according to the following equation. The smaller is the value, the higher is the stability of the tablet.

Degree of abrasion={[Tablet weight before testing (g)−Tablet weight after testing (g)]/Tablet weight before testing (g)}×100

Results thereof are shown in Table 2.

TABLE 1

| No. | Sulfite: Metabisulfite + Sulfite* | (Total content, wt. %) | Compound | (wt. %) | Dissolution time (min) | Storage stability | Remarks |
|---|---|---|---|---|---|---|---|
| 1 | 100:0 | 26.4 | D-sorbit | 3.0 | 58.0 | B | Comp. |
| 2 | 100:0 | 22.9 | D-sorbit | 12.0 | 71.0 | B | Comp. |
| 3 | 100:0 | 41.8 | D-sorbit | 3.0 | 58.5 | B | Comp. |
| 4 | 90:10 | 23.6 | D-sorbit | 3.0 | 50.0 | B | Comp. |
| 5 | 80:20 | 52.8 | D-sorbit | 3.0 | 48.0 | B | Comp. |
| 6 | 80:20 | 22.4 | D-sorbit | 3.0 | 17.0 | B | Inv. |
| 7 | 50:50 | 19.2 | D-sorbit | 3.0 | 15.6 | A | Inv. |
| 8 | 0:100 | 20.5 | D-sorbit | 1.0 | 13.2 | A | Inv. |
| 9 | 0:100 | 20.0 | D-sorbit | 3.0 | 13.0 | A | Inv. |
| 10 | 0:100 | 20.0 | D-sorbit | 6.0 | 13.5 | A | Inv. |
| 11 | 0:100 | 18.5 | D-sorbit | 12.0 | 15.3 | A | Inv. |
| 12 | 0:100 | 17.5 | D-sorbit | 18.0 | 17.5 | A | Inv. |
| 13 | 0:100 | 20.0 | D-mannit | 1.0 | 14.5 | B | Inv. |
| 14 | 0:100 | 20.0 | D-mannit | 3.0 | 14.5 | B | Inv. |
| 15 | 0:100 | 20.0 | D-mannit | 6.0 | 15.0 | A | Inv. |
| 16 | 0:100 | 20.0 | PEG (4000**) | 1.0 | 19.0 | A | Inv. |
| 17 | 0:100 | 20.0 | PEG (4000**) | 3.0 | 19.0 | A | Inv. |
| 18 | 0:100 | 20.0 | PEG (4000**) | 6.0 | 20.5 | A | Inv. |
| 19 | 0:100 | 20.0 | PEG (4000**) | 1.0 | 20.0 | A | Inv. |
| 20 | 0:100 | 20.0 | PEG (4000**) | 3.0 | 20.5 | A | Inv. |
| 21 | 0:100 | 20.0 | PEG (4000**) | 6.0 | 22.0 | A | Inv. |
| 22 | 0:100 | 20.0 | PVP (4000**) | 1.0 | 63.0 | C | Comp. |
| 23 | 0:100 | 20.0 | PVP (4000**) | 3.0 | 65.0 | C | Comp. |
| 24 | 0:100 | 20.0 | PVP (4000**) | 6.0 | 74.5 | C | Comp. |

*: Molar ratio

**: Molecular weight

As can be seen from the results, inventive samples were short in dissolution time and superior in storage stability.

Example 2

To the same granules as those used in Sample 9 of Example 9 was added a compound represented by formula (3) as shown in Table 2, and mixed for 3 min. by a mixer in a room controlled at 25° C. and 40% RH. The resulting mixture was subjected to compression-tableting according

TABLE 2

| No. | Compound | (wt. %) | Lubricity (kg) | hardness (kg) | Abrasiveness (%) | Remarks |
|---|---|---|---|---|---|---|
| 25 | Fumaric acid* | 1% | 210 | 41 | 4.22 | Comp. |
| 26 | Fumaric acid* | 3% | 180 | 40 | 6.50 | Comp. |
| 27 | Sarcosine* | 1% | 250 | 40 | 3.75 | Comp. |
| 28 | Sarcosine* | 3% | 170 | 40 | 3.83 | Comp. |
| 29 | Sodium benzoate* | 1% | 230 | 33 | 4.20 | Comp. |
| 30 | Sodium benzoate* | 3% | 175 | 35 | 3.68 | Comp. |
| 31 | 3-2 | 0.5% | 95 | 63 | 0.56 | Inv. |
| 32 | 3-2 | 1.0% | 75 | 65 | 0.70 | Inv. |
| 33 | 3-2 | 3.0% | 55 | 65 | 0.81 | Inv. |
| 34 | 3-3 | 0.5% | 90 | 60 | 0.56 | Inv. |
| 35 | 3-3 | 1.0% | 70 | 62 | 0.68 | Inv. |
| 36 | 3-3 | 3.0% | 65 | 62 | 0.83 | Inv. |
| 37 | 3-6 | 0.5% | 50 | 57 | 0.75 | Inv. |
| 38 | 3-6 | 1.0% | 45 | 55 | 0.88 | Inv. |
| 39 | 3-6 | 3.0% | 30 | 54 | 0.95 | Inv. |

*Comparative compound

As can be seen from the Table, inventive tablet samples were superior in lubricity and hardness and improved in abrasiveness, and having excellent stability as a tablet.

Example 3

A solid processing composition containing an alkali agent relating to the invention was prepared according to the following manner. Calcium carbonate was used as an alkali agent.

Preparation of granules (A'):

Potassium carbonate (in % by weight of the granules, as shown in Table 3 and 4) were pulverized up in a commercially available mill so as to have an average particle size of 50 $\mu$m. To the resulting fine particles, was added diethylenetriaminepentaacetic acid (DTPA) of 100 g, i-phenyl-5-mercaptotetrazole of 5 g, 5-mercapto-(1H)-tetrazolyl sodium salt of 5 g, D-mannit of 500 g and D-sorbitol of 300 g, and the mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier. Further, the granules were subjected to dressing with a dressing machine provided with 1.0 mm mesh to obtain granules (A').

Preparation of solid processing composition in the form of tablet:

To the thus-prepared granules (A') was added a cyclodextrin or a comparative compound as shown in Table 3 and 4. Further thereto exemplified compound 3—3 was added in an amount of 1.0% by weight and mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc.

Measurement of the hardness of the tablet and evaluation of abrasiveness was made in a similar manner to Example 2. Results thereof are shown in Table 3 and 4.

TABLE 3

| No. | $K_2CO_3$ (wt. %) | Cyclodextrin (CD) | (wt. %) | hardness (kg) | Abrasiveness (%) |
|---|---|---|---|---|---|
| 1 | 80.0 | — | — | 23 | 6.09 |
| 2 | 80.0 | β-100 | 15.0 | 48 | 2.02 |
| 3 | 80.0 | β-100 | 10.0 | 45 | 2.05 |
| 4 | 80.0 | β-100 | 5.0 | 44 | 2.33 |
| 5 | 80.0 | β-100 | 2.0 | 40 | 3.12 |
| 6 | 80.0 | Isoelite P | 15.0 | 45 | 1.80 |
| 7 | 80.0 | Isoelite P | 10.0 | 45 | 1.91 |
| 8 | 80.0 | Isoelite P | 5.0 | 43 | 2.30 |
| 9 | 80.0 | Isoelite P | 2.0 | 41 | 2.84 |
| 10 | 80.0 | Isoelite PH | 15.0 | 47 | 2.02 |
| 11 | 80.0 | Isoelite PH | 10.0 | 45 | 2.30 |
| 12 | 80.0 | Isoelite PH | 5.0 | 45 | 2.38 |
| 13 | 80.0 | Isoelite PH | 2.0 | 42 | 2.64 |
| 14 | 80.0 | Methyl-β-CD | 15.0 | 65 | 0.68 |
| 15 | 80.0 | Methyl-β-CD | 10.0 | 65 | 0.70 |
| 16 | 80.0 | Methyl-β-CD | 5.0 | 60 | 0.92 |
| 17 | 80.0 | Methyl-β-CD | 2.0 | 50 | 1.09 |
| 18 | 80.0 | Hydroxypropyl β-CD | 15.0 | 60 | 1.22 |
| 19 | 80.0 | Hydroxypropyl β-CD | 10.0 | 54 | 1.34 |
| 20 | 80.0 | Hydroxypropyl β-CD | 5.0 | 49 | 1.50 |
| 21 | 80.0 | Hydroxypropyl β-CD | 2.0 | 45 | 2.00 |

β-100: β-cylcodextrin
Isoelite P, Isoelite PH: branched cyclodextrin
Methyl-β-CD, Hydroxypropyl β-CD: alkylcyclodextrin

TABLE 4

| No. | $K_2CO_3$ (wt. %) | Cyclodextrim | (wt. %) | hardness (kg) | Abrasiveness (%) |
|---|---|---|---|---|---|
| 22 | 80.0 | D-glucose | 15.0 | 20 | 5.52 |
| 23 | 80.0 | D-glucose | 10.0 | 21 | 5.60 |
| 24 | 80.0 | D-glucose | 5.0 | 23 | 5.88 |
| 25 | 80.0 | D-glucose | 2.0 | 23 | 5.90 |
| 26 | 80.0 | D-fructose | 15.0 | 27 | 4.20 |
| 27 | 80.0 | D-fructose | 10.0 | 25 | 4.52 |
| 28 | 80.0 | D-fructose | 5.0 | 26 | 4.60 |
| 29 | 80.0 | D-fructose | 2.0 | 24 | 5.03 |
| 30 | 20.0 | — | — | 30 | 3.83 |
| 31 | 40.0 | — | — | 25 | 4.29 |
| 32 | 60.0 | — | — | 25 | 5.53 |
| 33 | 20.0 | Isoelite P | 10.0 | 50 | 1.20 |

TABLE 4-continued

| No. | $K_2CO_3$ (wt. %) | Cyclodextrim | (wt. %) | hardness (kg) | Abrasiveness (%) |
|---|---|---|---|---|---|
| 34 | 40.0 | Isoelite P | 10.0 | 46 | 1.22 |
| 35 | 60.0 | Isoelite P | 10.0 | 47 | 1.50 |
| 36 | 20.0 | Methyl-β-CD | 10.0 | 75 | 0.22 |
| 37 | 40.0 | Methyl-β-CD | 10.0 | 72 | 0.40 |
| 38 | 60.0 | Methyl-β-CD | 10.0 | 70 | 0.59 |
| 39 | 20.0 | Hydroxypropyl β-CD | 10.0 | 66 | 0.98 |
| 40 | 40.0 | Hydroxypropyl β-CD | 10.0 | 62 | 1.00 |
| 41 | 60.0 | Hydroxypropyl β-CD | 10.0 | 58 | 1.25 |
| 42 | 20.0 | D-fructose | 10.0 | 35 | 5.92 |
| 43 | 40.0 | D-fructose | 10.0 | 31 | 5.53 |
| 44 | 60.0 | D-fructose | 10.0 | 26 | 5.50 |

As can be seen from Tables 3 and 4, samples containing cyclodextrins (CD) were superior in hardness and abrasiveness.

Example 4

Preparation of solid developing composition

Preparation of granules (B):

Potassium carbonate of 1008 g and sodium bicarbonate of 200 g each were pulverized up in a commercially available mill so as to have an average particle size of 10 μm. To the resulting fine particles, was added DTPA.5Na of 250 g, 1-phenyl-5-mercaptotetrazole of 7.0 g and D-mannit of 800 g were added and the mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. Further, the granules were subjected to dressing with a dressing machine provided with 1.0 mm mesh to obtain granules (B).

Preparation of solid developing composition in the form of tablet:

To the thus prepared granules (B) was added an exemplified compound 3—3 and mixed for 10 min. by making use of a mixer in a room controlled to be not higher than 25° C. and 40% RH. The mixture was subjected to compression-molding to form a tablet so as to have a filling amount of 10 g per tablet, by making use of a tableting machine that was modified model of Tough Press Collect 1527HU manufactured by Kikusui Mfg. Works, Inc to obtain alkaline composition-tablets for use in development.

Preparation of solid fixing composition

Preparation of granules (C):

Ammonium thiosulfate/sodium thiosulfate (90/10 by weight) of 14580 g was pulverized up in a commercially available mill so as to have an average particle size of 10 μm. To the resulting fine particles, were added sodium sulfite 550 g, metabisulfite of 750 g and Pineflow 1220 g and the mixture was mixed in the mill for 3 min. In stirring granulator commercially available, the resulting mixture was granulated by adding 50 ml of water. The resulting granules were dried up at 50° C. in a fluidized bed drier so that the moisture content of the granules was almost completely removed off. Further, the granules were subjected to dressing with a dressing machine provided with 1.0 mm mesh to obtain granules (C).

Preparation of granules (D):

Boric acid of 600 g, aluminum sulfate octadecahydrate of 1480 g, cinnamic acid of 1100 g and tartaric acid of 300 g each were pulverized up in a commercially available mill so as to have an average particle size of 10 μm. To the resulting fine particles, was added D-sorbit of 50 g and D-mannit of 250 g and, in stirring granulator commercially available, the resulting mixture was granulated by adding 30 ml of water. The resulting granules were dried up at 50° C. for 2 hr. in a fluidized bed drier so that the moisture content of the granules was almost completely removed off. Further, the granules were subjected to dressing with a dressing machine provided with 1.0 mm mesh to obtain granules (D).

Preparation solid fixing composition in the form of tablet:

To the thus prepared granules (C) was added β-alanine of 3000 g sodium acetate of 4330 g and an exemplified compound of formula (3), compound 3—3 in an amount of 1.5% of the total weight. Further to the granules (D) sodium acetate of 750 g and an exemplified compound of formula (3), 3—3 in an amount of 1.0% of the total weight. Each was mixed for 10 min. by making use of a mixer in a room controlled to be not higher than 25° C. and 40% RH. The mixture of (C) or (D), each was subjected to compression-molding to form tablets C and D so as to have a filling amount of 10.2 or 11.2 g per tablet, respectively, by making use of a tableting machine that was modified model of Tough Press Collect 1527HU manufactured by Kikusui Mfg. Works, Inc. Thus, fixing composition tablets with 30 mm in diameter were prepared.

Preparation of processing solutions for use in processor:

A developing solution for use in the processor was prepared by dissolving developing composition tablets A and B in water to make a total amount of 1 liter. The tablets A and B each were prepared by compression-molding the granules (A) or (B), so as to have a concentration of the sulfite or carbonate, as shown in Table 5. In this case, the tablets were completely dissolved and no precipitate was observed. Thus prepared developing solution of 7.8 l was introduced into a processor SRX-201 (product by Konica Corp.) and a starter having the composition as below was added thereto in amount of 40 ml/l to prepare a starting developing solution. A fixing solution for use in the processor was prepared by dissolving fixing composition tablets C and D (24 tablets and 4 tablets, respectively) in water to make a total amount of 1 liter. The tablets C and d each were prepared by compression-molding the granules (C) and (D). In this case, the tablets were also completely dissolved and no precipitate was observed. Thus prepared fixing solution of 5.6 l was introduced into a processor SRX-201 as a starting fixing solution. A given amount of the developing solution and fixing solution, each was allowed to stand for 3 days at 50° C. and thereafter, no precipitate thereof was observed. The pH of the developing solution as a starting solution was 9.90.

| Starter | |
|---|---|
| KBr | 3.5 g |
| $HO(CH_2)_2S(CH_2)S(CH_2)_2OH$ | 0.05 g |
| Sulfuric acid or potassium hydroxide for pH-adjustment | |
| Water to make | 1 liter |

A chemical mixer built in the processor (SRX-201) was modified for use in the solid processing composition. Modified built-in chemical mixer was comprised of a solution-preparing tank and an auxiliary tank, each being controlled at a temperature of 30°±2° C. and having a capacity of 3.0 l. The auxiliary tank was provided in order to prevent occurrence of non-replenishing state during stirring and dissolving time (25 min.) when a replenishing solution was exhausted in running processing.

Opened package of solid developing or fixing composition tablets was set at the inlet of modified chemical mixer and at the same time when the tablets was supplied into the tank, warm water (25° to 30° C.) was also introduced to prepare the processing solution of 2.8 liter, with stirring and dissolving for 25 min. The resulting solution was used as a replenishing solution for developing or fixing solution. The pH of the developing solution and fixing solution was respectively adjusted to 10.15 and 4.80 with sulfuric acid or potassium hydroxide.

Processing was carried out at a developing temperature of 34° C., fixing temperature of 34° C. and drying temperature of 55° C. over total period of 60 sec. The replenishing rate was 14 ml per sheet of 10×12 inch.

Preparation of photographic light sensitive material

First, a light-sensitive material for evaluation purpose was prepared in the following manner.

Preparation of light-sensitive material

Preparation of Seed Emulsion-1:

Seed emulsion-1 was prepared in the following manner.

| | | | |
|---|---|---|---|
| A1 | Ossein gelatin | 24.2 | g |
| | Water | 9657 | ml |
| | Sodium polypropyleneoxy-polyethyleneoxy-disuccinate (in an aqueous 10% ethanol solution) | 6.78 | ml |
| | Potassium bromide | 10.8 | g |
| | 10% nitric acid solution | 114 | ml |
| B1 | Aqueous 2.5N silver nitrate solution | 2825 | ml |
| C1 | Potassium bromide | 841 | g |
| | Add water to make | 2825 | ml |
| D1 | An aqueous 1.75N potassium bromide solution | | |
| | An amount for controlling the following silver potential | | |

To Solution A1, Solutions B1 and C1 were each added in an amount of 464.3 ml at 42° C. by making use of a mixing stirrer shown in examined and published Japanese Patent 58-58288 and 58-58289 in a double-jet process by taking 1.5 minutes, so that nucleus grains were formed.

After stopping the addition of Solutions B1 and C1, the temperature of Solution A1 was raised to 60° C. by taking 60 minutes and the pH thereof was adjusted to be 5.0 by making use of a 3% KOH solution. Thereafter, Solutions B1 and C1 were each added thereto again at a flow rate of 55.4 ml/min. for 42 minutes in the double-jet process. At the time for raising the temperature from 42° C. to 60° C. and the time for the subsequent double-jet process carried out with Solutions B1 and C1, the silver potential (measured by a silver-ion selection electrode together with a saturated silver-silver chloride electrode as a control electrode) was so controlled as to be +8 mv and +16 mv by making use of Solution D1, respectively.

After the completion of the addition, the pH was adjusted to be 6 with a 3% KOH solution and a desalting treatment were immediately made. The resulting seed emulsion was proved through an electron microscope as follows. Not less than 90% of the whole projected area of the silver halide grains thereof were comprised of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.064 $\mu$m and 0.595 $\mu$m, respectively. Further, the variation coefficients of the grain thickness and the distance between the twin planes thereof were proved to be 40% and 42%, respectively.

Preparation of emulsion, Em-1:

By making use of Seed emulsion-1 and the following 4 kinds of solutions, silver halide tabular grain emulsion Em-1 was prepared.

| | | | |
|---|---|---|---|
| A2 | Ossein gelatin | 34.03 | g |
| | S-3 (in an aqueous 10% ethanol solution) | 2.25 | ml |
| | Seed emulsion-1 | Equivalent to 1.218 | mols |
| | Water to make | 3150 | ml |
| B2 | Potassium bromide | 1734 | g |
| | Water to make | 3644 | ml |
| C2 | Silver nitrate | 2478 | g |
| | Water to make | 4165 | ml |
| D2 | A fine-grained emulsion* comprising 3 wt % of gelatin and silver iodide grains (having an average grain-size of 0.05 $\mu$) | Equivalent to 0.080 | mols |

*To 6.64 liters of an aqueous 5.0 wt % gelatin solution containing 0.06 mols of potassium iodide, 2 liters each of an aqueous solution containing 7.06 mols of silver nitrate and an aqueous solution containing 7.06 mols of potassium iodide were added by taking 10 minutes. In the course of forming the fine grains, the pH was controlled to be 2.0 by making use of silver nitrate, and the temperature was controlled to be 40° C. After completing the grain formation, the pH was adjusted to be 6.0 by making use of an aqueous sodium carbonate solution.

In a reaction vessel, Solution A2 was vigorously stirred with keeping the temperature at 60° C. Thereto a part of Solution B2, a part of Solution C2 and the half amount of Solution D2 were each added in a triple-jet process by taking 5 minutes. Thereafter, the half amounts each of the remaining Solutions B2 and C2 were added successively by taking 37 minutes and, finally, the whole remaining amount of Solutions B2 and C2 were each added by taking 33 minutes. In the above-mentioned courses, the pH and pAg thereof were kept at 5.8 and 8.8 for all the while. Wherein, the flowing rates of Solutions B2 and C2 were acceleratedly varied so as to meet the critical growth rate.

Further, the above-mentioned Solution D2 was added in an amount equivalent to 0.15 mol % of the whole silver amount, so that a halogen conversion was performed.

After completing the additions, the resulting emulsion was cooled down to 40° C. and, thereto, 1800 ml of an aqueous solution of 13.8 wt % of gelatin modified with a phenylcarbamoyl group (substitution ratio of 90%), was added as a polymeric flocculent. The resulting emulsion was then stirred for 3 minutes. Thereafter, an aqueous 56 wt % of acetic acid solution was added thereto. The pH of the emulsion was adjusted to be 4.6. The emulsion was stirred for 3 minutes and was then allowed to stand for 20 minutes. The resulting supernatant was removed away by means of a decantation. Then, 9.0 liters of distilled water having a temperature of 40° C. was added. After stirring and then allowing it to stand, the resulting supernatant was removed away and 11.25 liters of distilled water was further added thereto. After stirring and allowing it to stand, the resulting supernatant was removed away. Successively, an aqueous gelatin solution and an aqueous 10 wt % sodium carbonate solution were added and the pH thereof was adjusted to be 5.80. The resulting solution was stirred at 50° C. for 30 minutes and was then redispersed. After completing the redispersion, the pH and pAg thereof were adjusted at 40° C. to be 5.80 and 8.06, respectively.

When observing the resulting silver halide emulsion through an electron microscope, it was proved to be the tabular-shaped silver halide grains having the average grain-size of 1.11$\mu$, the average thickness of 0.25$\mu$, the average aspect ratio of about 4.5 and the grain-size distribution of 18.1%. The average distance between the twin planes of the grains was 0.020$\mu$. In the ratio of the distance between the twin planes to the grain thickness, the grains having not lower than 5 thereof were proved to account for 97% (in numbers) of the total tabular-shaped silver halide grains. Those having not less than 10 were proved to account for 49% of the total grains, and those having not less than 15 accounted for 17% thereof.

Next, the resulting emulsion (Em-1) was raised to be 60° C. and a given amount of a spectral sensitization dye was added thereto in the form of a solid fine-grain dispersion. After adding it, an aqueous mixed solution of adenine, ammonium thiocyanate, chloroauric acid and sodium thiosulfate and a dispersion of triphenyl phosphine selenide were added and, after 60 minutes, a silver iodide fine-grained emulsion was added. Then, a chemical-ripening treatment was carried out for two hours in total. At the time of completing the ripening treatment, a given amount of 4-hydroxy-6-methyl-1,3,3a,7-tetrazaindene (TAI) was added as a stabilizer.

The above-mentioned additives and the amount of them added (per mol of AgX) are shown below.

| | |
|---|---|
| Anhydride of sodium 5,5'-dichloro-9-ethyl-3,3'-(3-sulfopropyl)-oxacarbocyanine | 400 mg |
| An anhydride of sodium 5,5'-di-(butoxycarbonyl)-1,1'-diethyl-3,3'-di-(4-sulfobutyl)-benzoimidazolocarbocyanine | 4.0 mg |
| Adenine | 15 mg |
| Potassium thiocyanate | 95 mg |
| Chloroauric acid | 2.5 mg |
| Sodium thiosulfate | 2.0 mg |
| triphenylphosphine selenide | 0.2 mg |
| Silver iodide fine grains | 280 mg |
| 4-hydroxy-6-methyl-1,3,3a,7-tetrazaindene (TAI) | 500 mg |

The solid, fine-grain, dispersion of the spectral sensitization dyes were each prepared in the process according to the process described in Japanese Patent Application No. 4-99437. To be more concrete, they were prepared in such a manner that a given amount of the spectral sensitization dye was added to water thermally controlled to be 27° C. and it was stirred at 3,500 rpm by making use of a high-speed dissolver for a period within the range of 30 to 120 minutes.

The dispersion of the above-mentioned selenium sensitizer was prepared in the following manner. Thus, 120 g of triphenylphosphine selenide was added to 30 kg of ethyl acetate kept at 50° C. and then so stirred as to be dissolved completely. On the other hand, 3.8 kg of photographic gelatin was dissolved in 38 kg of water and, thereto, an aqueous 25 wt % of sodium dodecylbenzene sulfonate was added. Next, these two solutions were mixed up and the resulting mixture was dispersed at 50° C. for 30 minutes by making use of a high-speed stirring disperser provided with a 10-cm dissolver at a dispersion blade speed of 40 m/sec. Thereafter, the remaining ethyl acetate was removed while a stirring was rapidly carried out under reduced pressure so that the ethyl acetate concentration could be not higher than 0.3 wt %. Then, the resulting dispersion was diluted by making use of pure water so as to make 80 kg. A part of the resulting dispersion was fractionally extracted so as to use for the above-mentioned experiment.

Preparation of emulsion layer coating solution

The following additives were added to each of the emulsions prepared in the above-mentioned manner.

| | |
|---|---|
| Compound (G) | 0.5 mg/m$^2$ |
| 2,6-bis(hydroxyamino)-4-diethylamino-1,3,5-triazine | 5 mg/m$^2$ |
| 1,1-Dimethylol-1-brom-1-nitromethane | 70 mg/m$^2$ |
| t-butyl-catechol | 130 mg/m$^2$ |
| Polyvinyl pyrrolidone (having a molecular weight of 10,000) | 35 mg/m$^2$ |
| A styrene-maleic acid anhydride copolymer | 80 mg/m$^2$ |
| Sodium polystyrene sulfonate | 80 mg/m$^2$ |
| Trimethylol propane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica (Ludox AM produced by du Pont, av. size: 0.013 $\mu$m) | 0.5 g/m$^2$ |

Gelatin was adjusted to be in an amount of 1.5 g/m$^2$.

Preparation of protective layer:

| | |
|---|---|
| Gelatin | 0.8 g/m$^2$ |
| A matting agent comprising polymethyl methacrylate (having an area average particle-size of 7.0 $\mu$m) | 50 mg/m$^2$ |
| Hardener $(CH_2{=}CHSO_2CH_2)_2O$ | 36 mg/m$^2$ |
| Sodium 2,4-dichloro-6-hydroxy-1,3,5-triazine | 10 mg/m$^2$ |
| Latex (L) | 0.2 g/m$^2$ |
| Polyacrylamide (having an average molecular weight of 10000) | 0.2 g/m$^2$ |
| Sodium polyacrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}$-O-$(CH_2CH_2O)_{11}$—H | 3 mg/m$^2$ |
| $C_8F_{17}SO_2(C_3H_7)N_2$—$(CH_2CH_2O)_{15}$H | 2 mg/m$^2$ |
| $C_8F_{17}SO_2N$—$(CH_2CH_2O)_4$—$(CH_2)_4SO_3Na$ | 1 mg/m$^2$ |

The amounts of the raw materials provided were for one side use, and the amounts of silver provided were each adjusted to be 1.6 g/m$^2$ for one side use.

Preparation of crossover-light shielding layer:

On the both sides of a support of a blue-tinted polyethylene terephthalate film for X-ray use (having a thickness of 175 $\mu$m) which was coated with a sublayer comprising copolymer of glycidyl methaacrylate of 50 wt. %, methyl methacrylate of 10 wt. % and butyl methacrylate of 40 wt. %, the following cross-over have light shielding layer was coated so as to have the following composition.

| | |
|---|---|
| Solid fine-grain dispersion of dye (AH) | 50 mg/m$^2$ |
| Gelatin | 0.2 g/m$^2$ |
| Sodium dodecylbenzene sulfonate | 5 mg/m$^2$ |
| Compound (I) | 5 mg/m$^2$ |
| Sodium 2,4-dichloro-6-hydroxy-1,3,5-triazine | 5 mg/m$^2$ |
| Colloidal silica (having an average particle-size of 0.014 $\mu$m) | 10 mg/m$^2$ |
| Poly(potassium stylenesulfonate) | 50 mg/m$^2$ |

-continued

Compound (S-1)

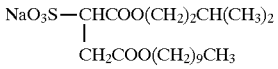

Compound (S-2)

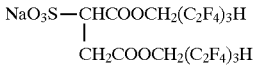

Compound (S-3)

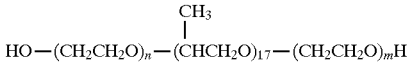

n + m = 5.7

Latex (L)

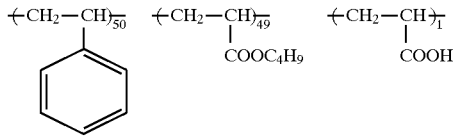

Polysiloxane (SI)

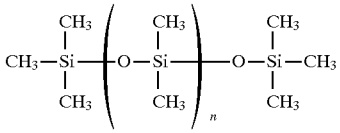

Dye (AH): Solid fine grain dispersion

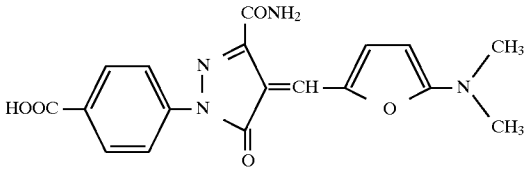

Compound (M)

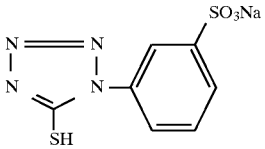

Compound (N)

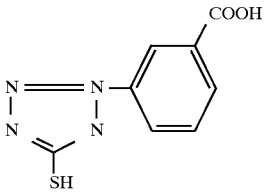

Compound (G)

-continued

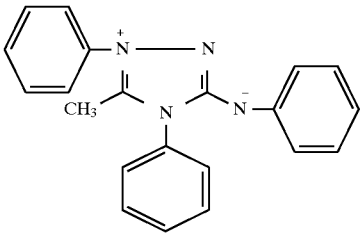

Compound (H)

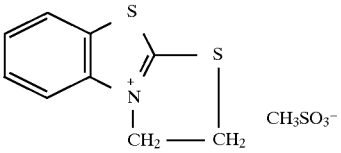

Compound (I)

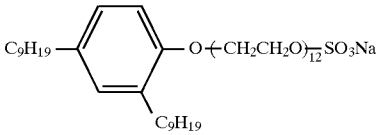

Compound (J)

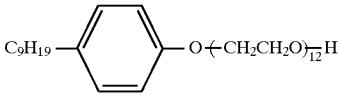

Compound (K)

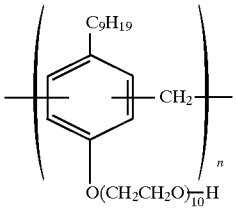

(mixture of n = 2–5)

Compound (O)
$C_{11}H_{23}CONH(CH_2CH_2O)_5H$
Compound (F-1)
$C_9F_{19}O(CH_2CH_2O)_{11}H$
Compound (F-2)

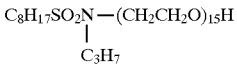

Compound (F-3)

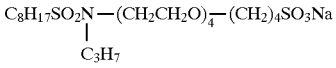

Coating:

These coating solutions were simultaneously coated on both sides of the support in amounts of silver of 1.6 g/m$^2$ and gelatin of 2.5 g/m$^2$, respectively, each per one side of support, using a slide hopper type coating machine at a speed of 120 per min. so as to have the following layer constitution; and dried for 2 min. 20 sec. Thus coated samples were prepared.

| Layer position | Kind of layer | Gelatin amt. of one side ($g/m^2$) |
|---|---|---|
| Upper layer | Protective layer | 0.8 |
| Intermediate layer | Emulsion layer | 1.5 |
| Lower layer | Filter layer | 0.2 |

Thus coated photographic material sample was evaluated as follows.

Evaluation of residual color

The sample was cut out in a size of 30.5 cm×25.4 cm and its unexposed one was processed according to the above-mentioned processing method. Residual color was visually evaluated, based on the following criteria.

A: Almost no residual color

B: Slight residual color

C: Residual color but acceptable for practical use.

D: Marked residual color and outside of practical use

Evaluation of silver sludge:

Coating samples of 2,000 sheets with a size of 10×12 inch. were exposed overall to light so as to give a density of 1.0±0.1, and then processed with the processor. Evaluation was visually made with respect to stains of the inside of the developing tank and transport rollers, based on the following criteria.

A: Level of no problem

B: Acceptable level

C: Problematic level

Sensitometrical evaluation of photographic performance:

The coating sample was laminated with fluorescent intensifying screens KO-250 (product by Konica) and exposed to X-ray under the conditions of a tube voltage of 90 kVp, current of 20 mA and a period of 0.05 sec., and according to the distance method, sensitometry curve was prepared to determined sensitivity. The sensitivity was determined as a reciprocal of an X-ray exposure amount necessary for a density of fog plus 1.0.

The sensitivity of a sample (b) which was processed after 2,000 sheets of samples with a size of 10×12 inch. overall-exposed so as to a density of 1.0±0.1 were processed, were shown as a relative value, based on the sensitivity of the sample which was processed with fresh processing solutions being 100. Results thereof are shown in Table 5.

TABLE 5

| No. | Sulfite (mol/l) | Carbonate (mol/l) | Sensitivity | Sludge | Residual color | Remarks |
|---|---|---|---|---|---|---|
| 1 | 0.03 | 0.27 | 70 | A | D | Comp. |
| 2 | 0.08 | 0.27 | 75 | A | D | Comp. |
| 3 | 0.12 | 0.27 | 75 | A | D | Comp. |
| 4 | 0.25 | 0.27 | 80 | B | D | Comp. |
| 5 | 0.35 | 0.27 | 85 | B | D | Comp. |
| 6 | 0.03 | 0.43 | 75 | A | D | Comp. |
| 7 | 0.08 | 0.43 | 94 | A | C | Inv. |
| 8 | 0.12 | 0.43 | 97 | A | C | Inv. |
| 9 | 0.25 | 0.43 | 97 | B | C | Inv. |
| 10 | 0.35 | 0.43 | 98 | C | C | Comp. |
| 11 | 0.03 | 0.65 | 77 | A | D | Comp. |
| 12 | 0.08 | 0.65 | 96 | A | B | Inv. |
| 13 | 0.12 | 0.65 | 97 | A | B | Inv. |
| 14 | 0.25 | 0.65 | 98 | B | B | Inv. |
| 15 | 0.35 | 0.65 | 98 | C | B | Comp. |
| 16 | 0.03 | 0.75 | 80 | A | C | Comp. |
| 17 | 0.08 | 0.75 | 96 | A | A | Inv. |
| 18 | 0.12 | 0.75 | 98 | A | A | Inv. |
| 19 | 0.25 | 0.75 | 99 | B | A | Inv. |
| 20 | 0.35 | 0.75 | 98 | C | A | Comp. |
| 21 | 0.03 | 1.00 | 80 | B | A | Comp. |
| 22 | 0.08 | 1.00 | 93 | C | A | Comp. |
| 23 | 0.12 | 1.00 | 94 | C | A | Comp. |
| 24 | 0.25 | 1.00 | 94 | C | A | Comp. |
| 25 | 0.35 | 1.00 | 94 | C | A | Comp. |

As can be seen from Table 5, inventive samples were proved to be little in lowering of sensitivity after running processing and improved in silver sludge and residual color.

What is claimed is:

1. A solid processing composition for developing a silver halide black-and-white photographic light sensitive material containing a compound represented by the following formula (1) as a developing agent in an amount of not less than 30% by weight of the composition, in which a metabisulfite, or the metabisulfite and a sulfite is contained in an amount of 1 to 50% by weight of the composition, a molar ratio of the sulfite to the metabisulfite and sulfite being not more than 0.85:

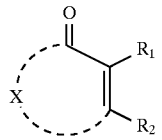

wherein R1 and $R_2$ each represent a hydroxy group, an amino group, an acylamino group, an alkylsulfonylamino group, an arylsulfonylamino group, and alkoxysulfonylamino group, a mercapto group or an alkylthio group; X represents an atomic group necessary for forming a 5- or 6-membered ring; and wherein said solid processing composition contains a saccharide or a compound represented by the following formula (2) in an amount of 0.5 to 30% by weight of the solid composition:

$$HO—(A_1—O)l_1—(A_2—O)l_2—(A_3—O)l_3—H \qquad \text{formula (2)}$$

wherein $A_1$, $A_2$ and $A_3$ each represents an alkyl group; $l_1$, $l_2$ and $l_3$ each represent 0 or an integer of 1 to 500, provided that the sum of $l_1$, $l_2$ and $l_3$ is not less than 5.

2. The solid processing composition of claim 1, wherein said solid composition contains an organic sulfur compound represented by the following formula (3) in amount of 0.01 to 3.0% of the total weight:

$$R—S_xO_yM \qquad \text{formula (3)}$$

wherein R represents an aliphatic group, aromatic group or heterocyclic group; x is 1 or 2; y is an integer of 2 to 8; and M represents a cation.

3. The solid processing composition of claim 1, wherein said solid composition is in the form of granules or a tablet.

4. The solid processing composition of claim 3, wherein said solid composition is in the form of a tablet.

5. The solid processing composition of claim 4, wherein said solid composition in the form of a tablet is prepared by compression-molding said solid processing composition in the form of granules.

6. The solid processing composition of claim 4, wherein said solid processing composition in the form of a tablet has a bulk density of 1.0 to 2.5 $g/cm^3$.

* * * * *